US007546047B2

(12) United States Patent
Kyung

(10) Patent No.: US 7,546,047 B2
(45) Date of Patent: Jun. 9, 2009

(54) IMAGE FORMING APPARATUS AND METHOD OF CONTROLLING THE SAME HAVING FIXED DEVELOPING APPARATUSES

(75) Inventor: Myung-ho Kyung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 388 days.

(21) Appl. No.: 11/357,117

(22) Filed: Feb. 21, 2006

(65) Prior Publication Data

US 2006/0153584 A1 Jul. 13, 2006

Related U.S. Application Data

(63) Continuation-in-part of application No. 10/799,693, filed on Mar. 15, 2004, now abandoned, which is a continuation-in-part of application No. 10/609,422, filed on Jul. 1, 2003, now abandoned.

(30) Foreign Application Priority Data

Jul. 2, 2002 (KR) ..... 10-2002-0038051

(51) Int. Cl.
*G03G 15/06* (2006.01)
*G03G 15/08* (2006.01)

(52) U.S. Cl. ..... 399/55; 399/285

(58) Field of Classification Search ..... 399/55, 399/235, 270, 285
See application file for complete search history.

(56) References Cited

U.S. PATENT DOCUMENTS 4,939,547 A 7/1990 Miyaji et al.
4,947,212 A 8/1990 Ikegawa et al.
5,270,782 A 12/1993 Floyd, Jr.
5,324,884 A 6/1994 Honda et al.
5,376,998 A 12/1994 Suzuki
5,628,043 A 5/1997 Ikeda et al.
5,630,200 A 5/1997 Christy
5,826,144 A * 10/1998 Takenaka et al. ..... 399/222
6,067,427 A * 5/2000 Shin ..... 399/53
6,125,245 A 9/2000 Shibuya et al.
6,134,397 A 10/2000 Shimazaki et al.
6,253,040 B1 6/2001 Kopp et al.
6,353,720 B1 * 3/2002 Sakai et al. ..... 399/234
6,928,254 B2 8/2005 Choi et al.

FOREIGN PATENT DOCUMENTS

JP 58158657 9/1983

* cited by examiner

*Primary Examiner*—Robert Beatty
(74) *Attorney, Agent, or Firm*—Staas & Halsey LLP

(57) ABSTRACT

An image forming apparatus includes a photoconductive medium electrified by an electrifying apparatus to a predetermined electric potential, a plurality of color developing apparatuses which are fixed around the photoconductive medium, each color developing apparatus having a developing roller to adhere a predetermined color toner to an electrostatic latent image formed on the photoconductive medium by a laser scanning unit, and a supplying roller to supply a toner to the developing roller, a voltage supplying apparatus to apply a predetermined bias voltage to the developing roller and the supplying roller, and a controlling apparatus to control a degree and a timing of applying the bias voltages to the developing roller and the supplying roller to control a movement state of the toner between the supplying roller and the developing roller.

20 Claims, 31 Drawing Sheets

IMAGE FORMING APPARATUS AND METHOD OF CONTROLLING THE SAME HAVING FIXED DEVELOPING APPARATUSES

CROSS-REFERENCE TO RELATED APPLICATIONS

This application is a continuation in part of U.S. application Ser. No. 10/799,693, filed on Mar. 15, 2004, now abandoned, which is a continuation in part of U.S. application Ser. No. 10/609,422, filed Jul. 1, 2003, now abandoned.

This application claims the benefit of Korean Application No. 2002-38051, filed Jul. 2, 2002, in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus and a method of controlling the same, which develops an electrostatic latent image formed on a photoconductive medium.

2. Description of the Related Art

Generally, an electrophotographic image forming apparatus such as a laser printer, a copier, or a facsimile machine obtains a desired image by adhering toner onto an electrostatic latent image formed on a photoconductive medium, developing the electrostatic latent image, and transferring the developed toner image to a printing paper.

FIG. 1 illustrates a general conventional image forming apparatus including a laser scanning unit (LSU) 10 which generates a laser beam, a photoconductive medium 20 on which an electrostatic latent image is formed by the generated laser beam and an electrifying apparatus 30 which electrifies a surface of the photoconductive medium 20 to a predetermined electric potential. The conventional image forming apparatus also includes a developing unit 40 which forms a toner image by adhering a toner onto an electrostatic latent image of the photoconductive medium 20, a transferring unit 50 which transfers the toner image formed on the photoconductive medium 20 to a paper P, a fusing unit 60 which fuses the transferred toner image on the paper P, and a paper supplying unit 70 which supplies the paper P.

The developing unit 40 includes four developing apparatuses 42, 43, 44, 45 supplying color toner of yellow, magenta, cyan and black, respectively. The developing apparatuses 42, 43, 44, 45 each include a toner receptacle 46 to store the color toner, a developing roller 47 to adhere the color toner stored in the toner receptacle 46 onto the electrostatic latent image of the photoconductive medium 20, and a gap ring 48 to maintain a predetermined gap between the developing roller 47 and the photoconductive medium 20. The developing apparatuses 42, 43, 44, 45 are disposed on a circular turret 41 at a predetermined interval, and are moved toward the photoconductive medium 20 by rotation of the turret 41.

The transferring unit 50 includes a transfer belt 51 to transfer the toner image formed on the photoconductive medium 20 to the paper P, a first transfer roller 52 to transfer the toner image to the transfer belt 51, and a second transfer roller 53 to transfer the toner image which is transferred to the transfer belt 51 to the paper P.

In the conventional image forming apparatus, when the LSU 10 scans a laser beam to the photoconductive medium 20 electrified by the electrifying apparatus 30, the electrostatic latent image is formed as the electric potential becomes low where the laser beam is scanned. If the yellow developing apparatus 42 approaches the photoconductive medium 20 as the turret 41 rotates, a gap is formed between the developing roller 47 and the photoconductive medium 20 by a contact of the gap ring 48 with a surface of the photoconductive medium 20. At this time, the yellow toner in the toner receptacle 46 is adhered onto the electrostatic latent image formed on the photoconductive medium 20 by the developing roller 47. The yellow toner image formed on the photoconductive medium 20 is transferred from between the photoconductive medium 20 and the first transfer roller 52 to the transfer belt 51.

The above developing and transferring processes are repeated with respect to the remaining three developing apparatuses 43, 44, 45. As a result, on the transfer belt 51 is formed a color image which is an overlap of the four colors. The color image is transferred from the transfer belt 51 to the paper P by the second transfer roller 53. The color image adhered onto the paper P in a powder state is fused on the paper P by the fusing unit 60.

However, the conventional image forming apparatus generates noise due to collision of the gap ring 48 of the developing unit 40 with the surface of the photoconductive medium 20 when the four developing apparatuses 42, 43, 44, 45 of the developing unit 40 approach the photoconductive medium 20 by the rotation of the turret 41. Additionally, due to the collision of the photoconductive medium 20 and the gap ring 48, the powdery toner image on the photoconductive medium 20 can be scattered and causes deterioration of the printing quality.

SUMMARY OF THE INVENTION

Accordingly, it is an aspect of the present invention to solve at least the above problems and/or disadvantages and to provide at least the advantages described below.

It is another aspect of the present invention to provide an image forming apparatus and control method thereof capable of implementing a high-quality image since a plurality of developing apparatuses are fixed at proper positions around a photoconductive medium when developing images to prevent collision of the developing apparatus with the photoconductive medium.

Additional aspects and/or advantages of the invention will be set forth in part in the description which follows and, in part, will be apparent from the description, or may be learned by practice of the invention.

The foregoing and/or other aspects are achieved by providing an image forming apparatus including an electrifying apparatus, a photoconductive medium electrified by the electrifying apparatus to a predetermined electric potential, a laser scanning unit, a plurality of color developing apparatuses which are fixed around the photoconductive medium, each of the color developing apparatuses having a developing roller to adhere a predetermined color toner to an electrostatic latent image formed on the photoconductive medium by the laser scanning unit, and a supplying roller to supply the toner to the developing roller, a voltage supplying apparatus to supply a predetermined bias voltage to the developing roller and the supplying roller, and a controlling apparatus to control a degree and a timing of supplying the bias voltage to the developing roller and the supplying roller to control a movement state of the toner between the supplying roller and the developing roller.

The controlling apparatus may control one of the plurality of color developing apparatuses to perform a developing operation of adhering a predetermined one of the color toners to the photoconductive medium.

The controlling apparatus may control the voltage supplying apparatus to satisfy equation 1 as follows when performing the developing operation:

$$|Vd|<|Vs| \quad \text{[Equation 1]}$$

wherein Vd denotes the bias voltage supplied to the developing roller and Vs denotes the bias voltage supplied to the supplying roller.

The photoconductive medium may have an image area formed on a first part thereof, on which the electrostatic latent image is formed, and a non-image area formed on a second part thereof, and a toner supply area is provided between the developing roller and the supplying roller to move the toner and a developing area is provided between the supplying roller and the photoconductive medium to move the toner. If a circular length of the developing roller from a center of the toner supply area to a center of the developing area in a rotation direction of the developing roller is denoted by $C_d$ and if a circular length of the photoconductive medium from a starting point of the image area to the center of the developing area in a rotation direction of the photoconductive medium is denoted by $C_{0\cdot F}$, the controlling apparatus may control the voltage supplying apparatus to satisfy equation 1 from a time when the starting point of the image area satisfies:

$$C_{0\cdot F}=(C_d+\alpha_1\cdot L)\cdot(So/Sd),\ 0\leqq\alpha_1<0.5 \quad \text{[Equation 1-1]}$$

wherein L denotes an arc length of the non-image area, So denotes a normal velocity of the circumference of the photoconductive medium, Sd denotes a normal velocity of the circumference of the developing roller, and $\alpha_1$ denotes a real number.

The controlling apparatus may further control the voltage supplying apparatus to satisfy equation 2 as follows for a predetermined time when performing the developing operation:

$$|Vd|=|Vs| \quad \text{[Equation 2]}$$

The photoconductive medium may have an image area formed on a first part thereof, on which the electrostatic latent image is formed, and a non-image area formed on a second part thereof, and a toner supply area is provided between the supplying roller and the developing roller to move the toner and a developing area is provided between the supplying roller and the photoconductive medium to move the toner. If a circular length of the developing roller from a center of the toner supply area to a center of the developing area in a rotation direction of the developing roller is denoted by $C_d$ and if a circular length of the photoconductive medium from an end point of the image area to the center of the developing area in a rotation direction of the photoconductive medium is denoted by $C_{0\cdot L}$, the controlling apparatus may control the voltage supplying apparatus to satisfy equation 2 from a time when equation 2-1 is satisfied:

$$C_{0\cdot L}=(C_d-\alpha_2\cdot L)\cdot(So/Sd),\ 0\leqq\alpha_2<0.5 \quad \text{[Equation 2-1]}$$

wherein L denotes an arc length of the non-image area, So denotes a normal velocity of a circumference of the photoconductive medium, Sd denotes a normal velocity of a circumference of the developing roller, and $\alpha_2$ is a real number.

The controlling apparatus may control the voltage supplying apparatus to satisfy equation 3 as follows and thereby collects the toner after the developing operation:

$$|Vd|>|Vs| \quad \text{[Equation 3]}$$

If, with reference to a point of time satisfying equation 2-1, a circular length of the photoconductive medium from a first position of the non-image area defined by g equation 3-1 as follows to the center of the developing area is denoted by $C_{0\cdot P1}$ and if the first position further moves from an initial point of the circular length $C_{0\cdot L}$ satisfying equation 2-1 by a difference between the circular lengths $C_{0\cdot L}$ and $C_{0\cdot P1}$, the controlling apparatus may control the voltage supplying apparatus to satisfy equation 3 and thereby collects the toner:

$$C_{0\cdot P1}=\{C_d-(\alpha_2-\beta_2)\cdot L\}\cdot(So/Sd),$$

$$0\leqq\alpha_2<0.5,$$

$$0\leqq\beta_2<0.5 \quad \text{[Equation 3-1]}$$

wherein $\alpha_2$ and $\beta_2$ denote real numbers, respectively, and $(\alpha_2+\beta_2)$ is less than 0.5.

If, with reference to the point of time satisfying equation 2-1, a circular length of the photoconductive medium from a second position of the non-image area defined by equation 2-2 as follows to the center of the developing area is denoted by $C_{0\cdot P2}$ and if the second position further moves from the initial point of the circular length $C_{0\cdot L}$ satisfying equation 2-1 by a difference between the circular lengths $C_{0\cdot L}$ and $C_{0\cdot P2}$, the controlling apparatus may control the voltage supplying apparatus to satisfy equation 2 or stop the supply of the voltage:

$$C_{0\cdot P2}=[C_d+\{1-(\alpha_1+\beta_1+2\alpha_2)\}\cdot L]\cdot(So/Sd),$$

$$0\leqq\alpha_1<0.5,$$

$$0\leqq\beta_1<0.5 \quad \text{[Equation 2-2]}$$

wherein $\alpha_1$ and $\beta_1$ denote real numbers, respectively, and $(\alpha_1+\beta_1)$ is less than 0.5.

The image forming apparatus may further include a gap ring disposed at both ends of the developing roller and being rotated in contact with the photoconductive medium to maintain a developing gap between the developing roller and the photoconductive medium.

The image forming apparatus may further include a transferring unit on which color toner images developed on the photoconductive medium are overlapped with one another.

The foregoing and/or other aspects are also achieved by providing a controlling method of an image forming apparatus which includes a plurality of color developing apparatuses which are fixedly arranged in a moving direction of a photoconductive medium in order of colors each of the developing apparatuses adhering a toner supplied from a supplying roller to a developing roller to the photoconductive medium, and a voltage supplying apparatus to supply a predetermined bias voltage to the developing roller and the supplying roller of each of the developing apparatuses. The method includes adhering a predetermined color toner to the photoconductive medium using one of the plurality of developing apparatuses, and collecting remainder toner which is not in use during a developing operation and remains in the developing roller on the supplying roller.

The collecting operation may be performed after the developing operation is completed, and may be performed by at least one of the remaining developing apparatuses which are not performing developing. The collecting operation includes applying the supplying roller with a bias voltage having a lower absolute value than that of the developing roller.

The collecting operation may further include supplying the developing roller with a bias voltage which has an absolute value greater than that of an electrostatic latent image area of the photoconductive medium and less than a non-electrostatic latent image area.

The developing operation includes a first supplying operation of supplying the developing roller with a bias voltage having a lower absolute value than that of the supplying roller, and a second supplying operation of supplying the developing roller and the supplying roller with a bias voltage having the same absolute value.

The collecting operation may be accomplished subsequent to the second supplying operation.

BRIEF DESCRIPTION OF THE DRAWINGS

These and/or other aspects and/or advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
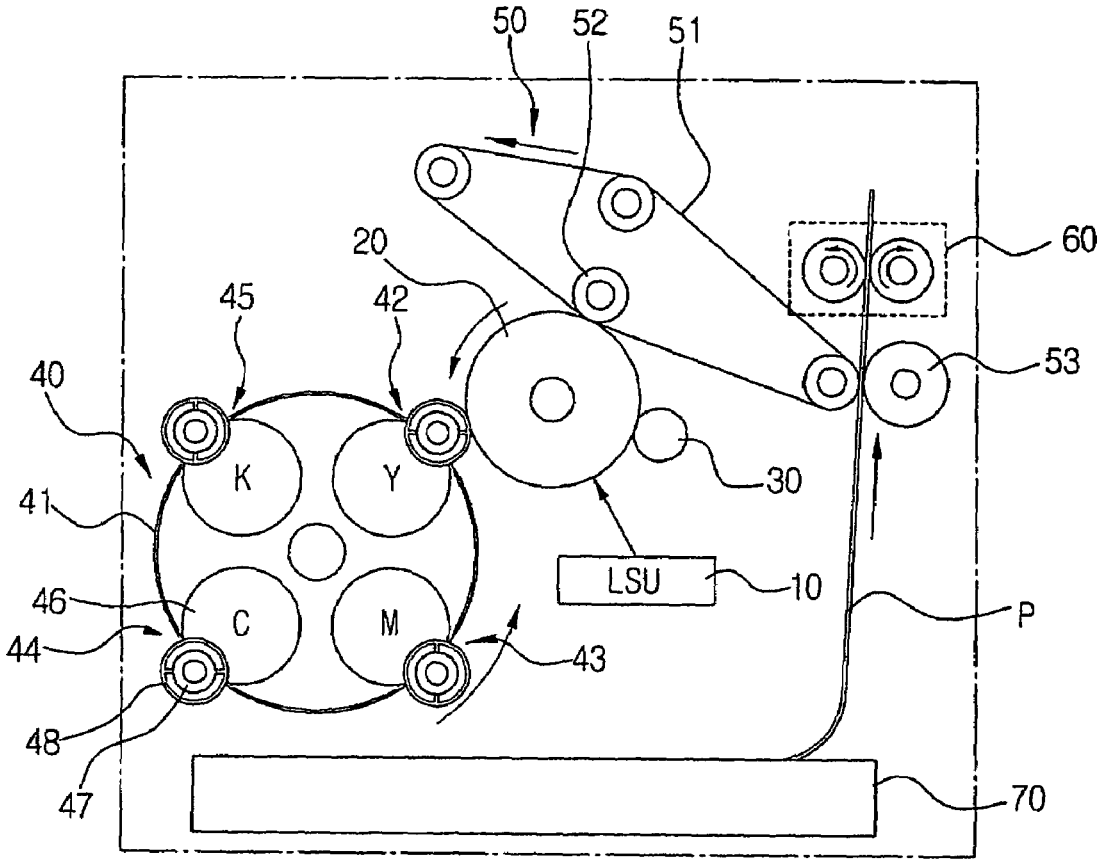
FIG. 1 (PRIOR ART)
FIG. 1 schematically shows the structure of a conventional image forming apparatus.

Reference will now be made in detail to the present embodiments of the present invention, examples of which are illustrated in the accompanying drawings, wherein like reference numerals refer to like elements throughout.

Figure 2:
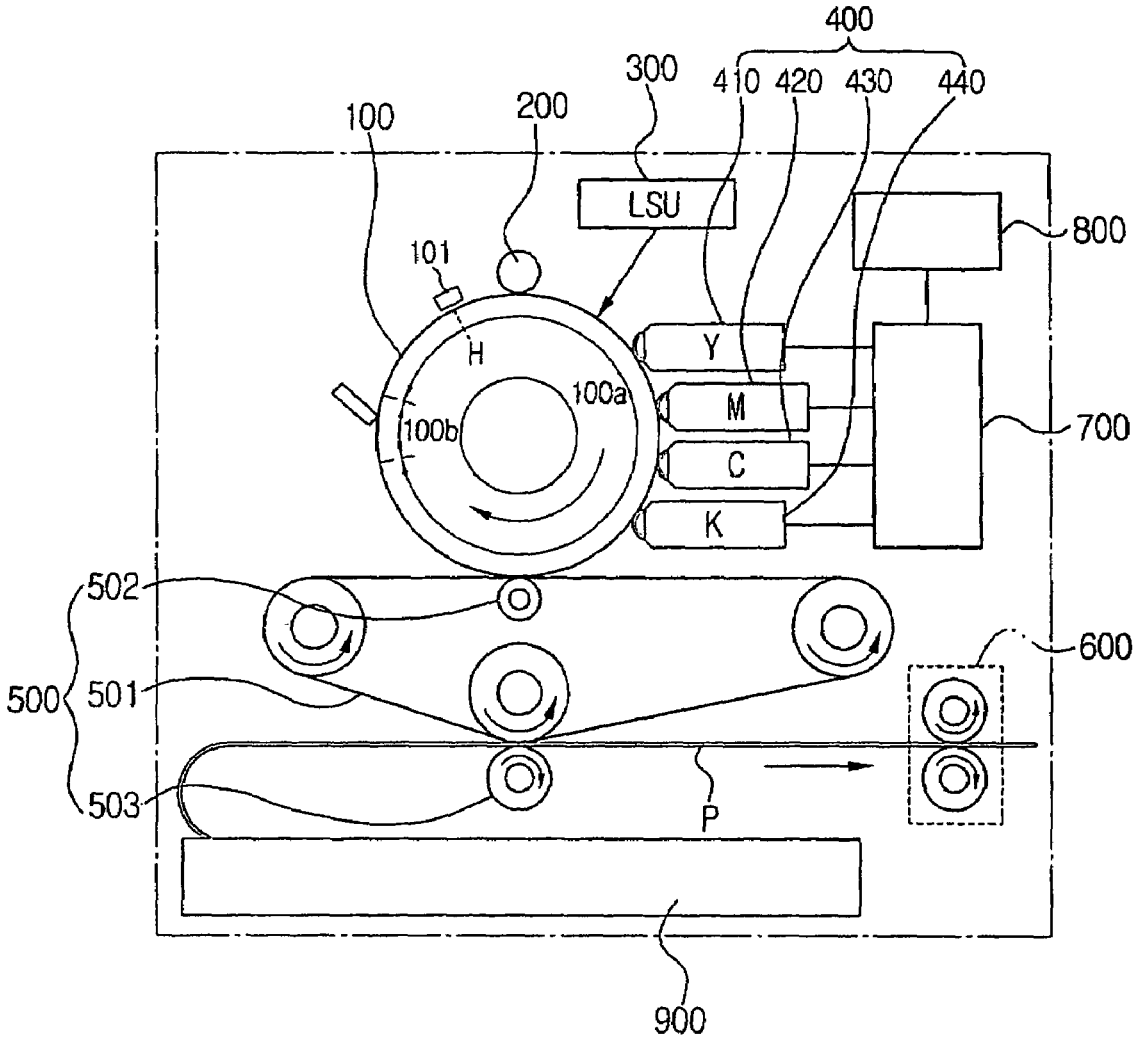
FIG. 2 schematically shows the structure of an image forming apparatus according to a first embodiment of the present invention.

As shown in FIG. 2, the image forming apparatus according to a first embodiment of the present invention includes a photoconductive medium 100, a developing unit 400, a voltage supplying apparatus 700, and a controlling apparatus 800.

The photoconductive medium 100 is electrified to a predetermined electric potential by an electrifying apparatus 200 and forms an electrostatic latent image by a laser beam scanned by a laser scanning unit 300. The photoconductive medium 100 is divided into an image area 100*a* on which a one-page electrostatic latent image of printing medium P is formed by the laser scanning unit 300, and a non-image area 100*b* formed on the remaining portion of the photoconductive medium 100.

Although in this embodiment the one-page electrostatic latent image of printing medium P is formed on the image area 100*a*, this should not be considered as limiting. An electrostatic latent image corresponding to one or more pages may be formed on the image area 100*a*, or if necessary, an image may be formed on the non-image area 100*b*.

The photoconductive medium 100 is in the shape of a drum that is rotated at a certain speed and in a certain direction. However, this should not be considered as limiting. The photoconductive medium 100 may also be a belt that is divided into the image area 100*a* and non-image area 100*b*.

The photoconductive medium 100 includes a home sensor 101 to detect a home position H formed on an outer circumference of the photoconductive medium 100. The home sensor 101 may be located in front of the electrifying apparatus 200 in a rotation direction of the photoconductive medium 100.

An electrostatic latent image starts to be formed on the photoconductive medium 100 by the laser scanning unit 300 after the home position H is sensed by the home sensor 101. In other words, the home sensor 101 detects the home position H and thereby determines when the laser scanning unit 300 is expected to scan a laser beam. A predetermined period from the time when the home position H is detected to the time when the laser scanning unit 300 starts to scan the laser beam is set in advance by the controlling apparatus 800.

Although in this embodiment, the home sensor 101 is located in front of the electrifying apparatus 200, this should not be considered as limiting. For example, the home sensor 101 may be located between the electrifying apparatus 200 and the laser scanning unit 300 to detect the home position H on the photoconductive medium 100 before the laser scanning operation is performed.

The developing unit 400 adheres color toners onto the image area 100*a* and develops the electrostatic latent image into color toner images. The color toner images developed on the photoconductive medium 100 by the developing unit 400 are transferred to a transfer belt 501 and are overlapped to form a color image, and the color image is transferred to printing paper P conveyed from a paper cassette 900.

A transferring unit 500 includes the transfer belt 501 to receive the toner images of different colors so that the transferred toner images are overlapped to form a color-image, a first transfer roller 502 to transfer the color toner images formed on the photoconductive medium 100 to the transfer belt 501 in order, and a second transfer roller 503 to transfer the color image formed on the transfer belt 501 to the printing paper P.

The color image transferred to the printing paper P is in a powdery state, and is fused on the printing paper P by a fusing unit 600 with heat and pressure.

The developing unit 400 includes first to fourth developing apparatuses 410, 420, 430, 440 respectively containing different colors of toner, for example, yellow (Y), magenta (M), cyan (C), and black (B), and fixed around the photoconductive medium 100. The toner colors of the developing apparatuses 410, 420, 430, 440 are not limited to these colors. The number of developing apparatuses may be more than 4 and thus the number of colors of toner stored in the developing unit 400 may be more than 4.

Figure 3A:
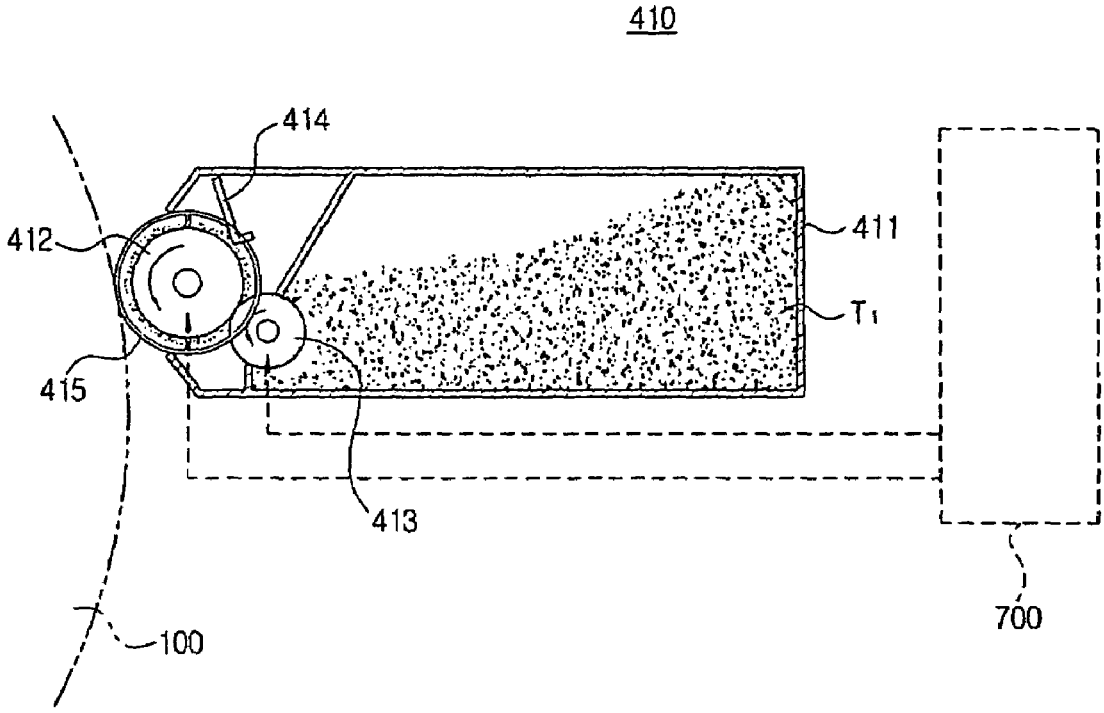
FIGS. 3A and 3B show the structure and operation of a developing unit of the image forming apparatus of FIG. 2.

As shown in FIG. 3A, the developing apparatus 410 includes a first toner receptacle 411, a first developing roller 412 to adhere a toner T1 onto the image area 100*a* of the photoconductive medium 100, and a first supplying roller 413 to supply the first developing roller 412 with the toner T1.

The first toner receptacle 411 stores a yellow toner T1, and the first developing roller 412 is partially protruded to the outside of the first toner receptacle 411 and rotatably disposed. A gap ring 415 is disposed on opposite ends of the first developing roller 412 and rotates in contact with the photoconductive medium 100 to maintain a predetermined gap between the first developing roller 412 and the photoconductive medium 100.

The first supplying roller 413 is disposed in the first toner receptacle 411 and rotates in contact with the first developing roller 412 to supply the yellow toner T1 to the first developing roller 412. A first regulation blade 414 controls the thickness of the yellow toner T1 supplied to the first developing roller 412 by the first supplying roller 413 to a proper extent.

Figure 3B:
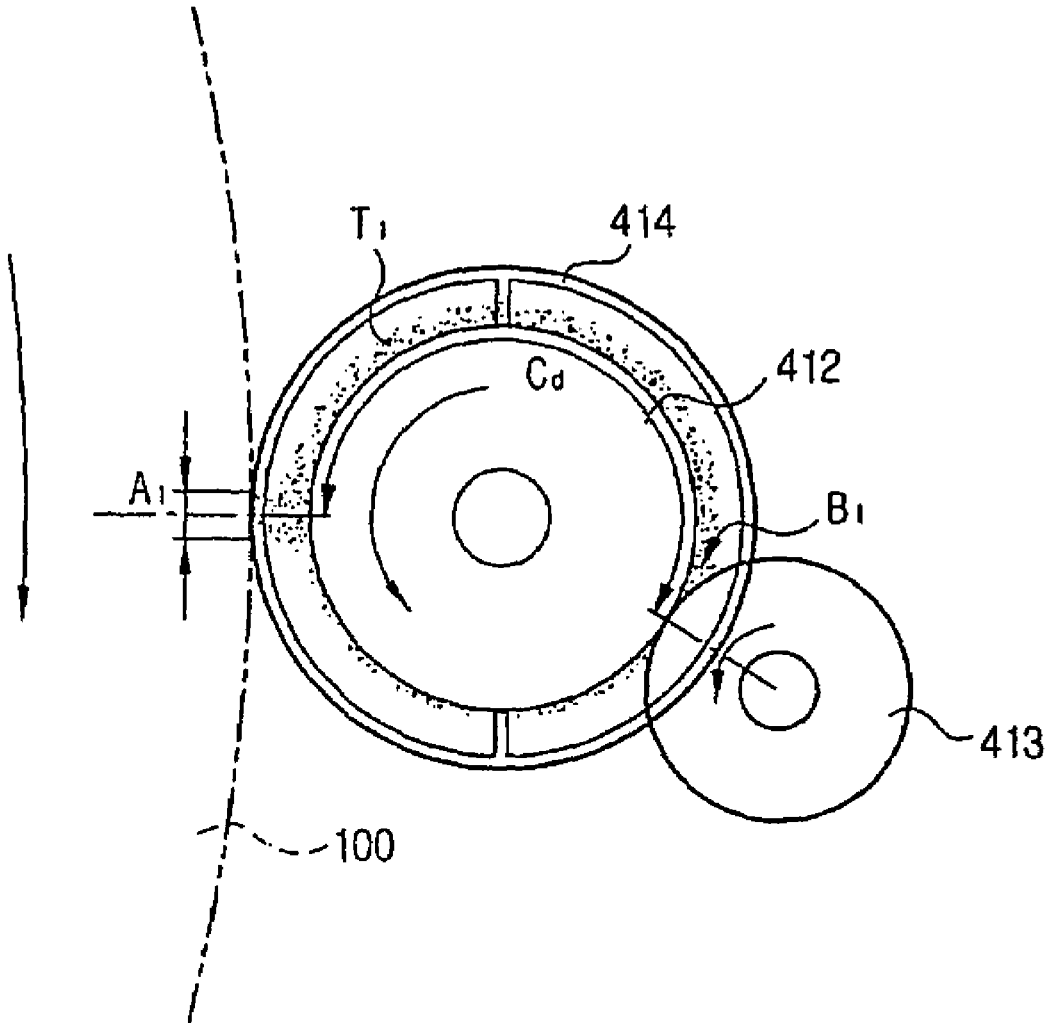

As shown in FIG. 3B, a first toner supply area B1 is formed between the first developing roller 412 and the first supplying roller 413 to supply the yellow toner T1 to the first developing roller 412. A first developing area A1 is formed between the photoconductive medium 100 and the first developing roller 412, through which the yellow toner T1 of the first developing roller 412 is transferred to the photoconductive medium 100.

When the image area 100*a* of the photoconductive medium 100 passes the first developing area A1, the yellow toner T1 on the surface of the first developing roller 412 is adhered onto the electrostatic latent image, and accordingly, a toner image is formed.

Figure 4A:
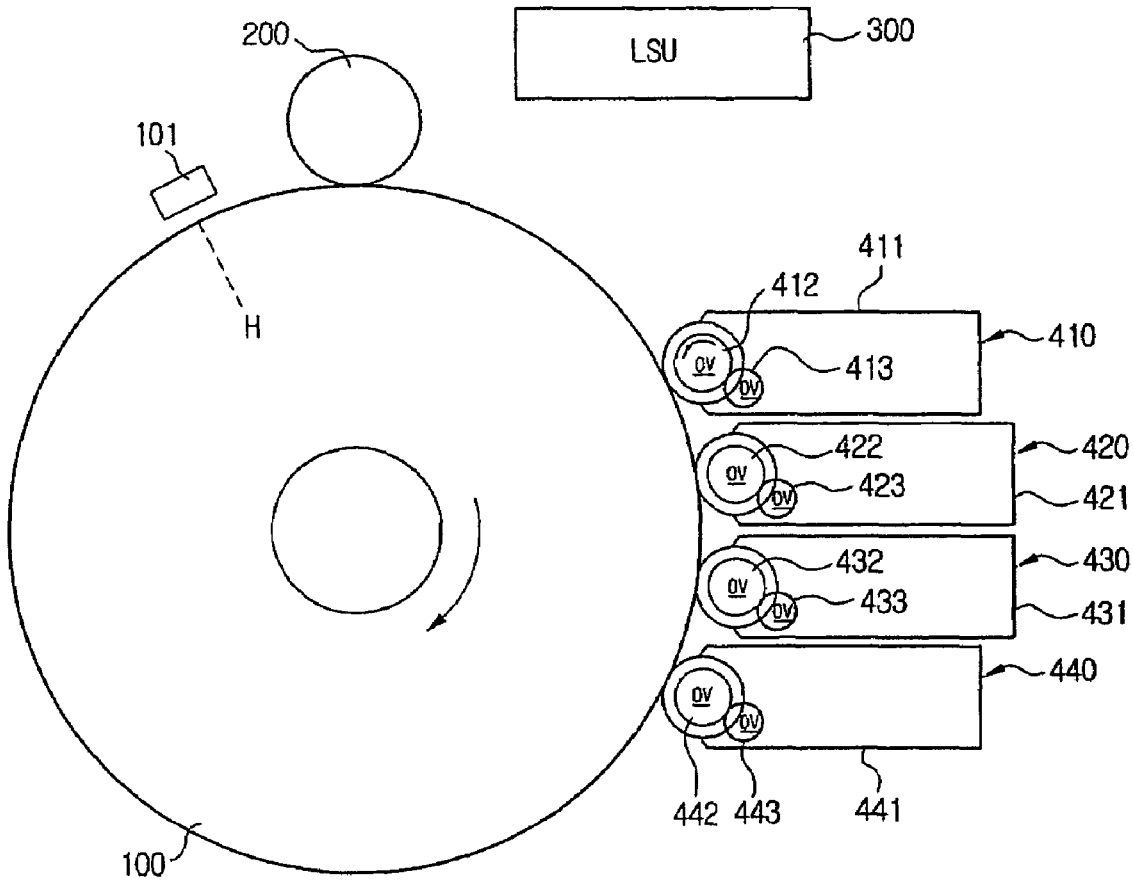
FIGS. 4A to 5E show the operation of the image forming apparatus of FIG. 2.

The other three developing apparatuses 420, 430, 440 of the developing unit 400, as shown in FIG. 4A, each include a toner receptacle 421, 431, 441, a developing roller 422, 432, 442, and a supplying roller 423, 433, 443. The structure of the three developing apparatuses 420, 430, 440 is similar to the first developing apparatus 410, and therefore a detailed description thereof will be omitted.

According to the first embodiment, the developing rollers 412, 422, 432, 442 have the same diameter, the same rotation velocity and rotation direction. Also, the developing rollers 412, 422, 432, 442 rotate at the same normal velocity as the photoconductive medium 100 but rotate in a different direction to the photoconductive medium 100. For example, the photoconductive medium 100 rotates in a clockwise direction, while the developing rollers 412, 422, 432, 442 rotate in a counterclockwise direction.

However, the developing rollers 412, 422, 432, 442 and the photoconductive medium 100 may rotate in the same direction or rotate at a different velocity, and a detailed description thereof will be made through the following embodiments.

The plurality of developing rollers and supplying rollers are generally electrified with a negative voltage to adhere a toner thereto. Accordingly, the toner is moved from a side having a high voltage absolute value to a side having a low voltage absolute value. However, this should not be considered as limiting. A positively electrified roller may instead be used.

The voltage supplying apparatus 700 applies a predetermined bias voltage to the respective developing rollers 412, 422, 432, 442 and the respective supplying rollers 413, 423, 433, 443 of the first to the fourth developing apparatuses 410, 420, 430, 440.

The controlling apparatus 800 controls the degree and timing of applying the bias voltage to the respective developing rollers 412, 422, 432, 442 and the respective supplying rollers 413, 423, 433, 443. The controlling apparatus 800 controls the voltage supplying apparatus 700 to determine a movement state of the toner between the supplying rollers 413, 423, 433, 443 and the developing rollers 412, 422, 432, 442 and the developing rollers 412, 422, 432, 442 and the photoconductive medium 100.

The controlling apparatus 800 controls the voltage supplying apparatus 700 such that one of the developing apparatuses 410, 420, 430, 440 performs the operation of adhering a certain color of toner onto the photoconductive medium 100.

Figure 4B:
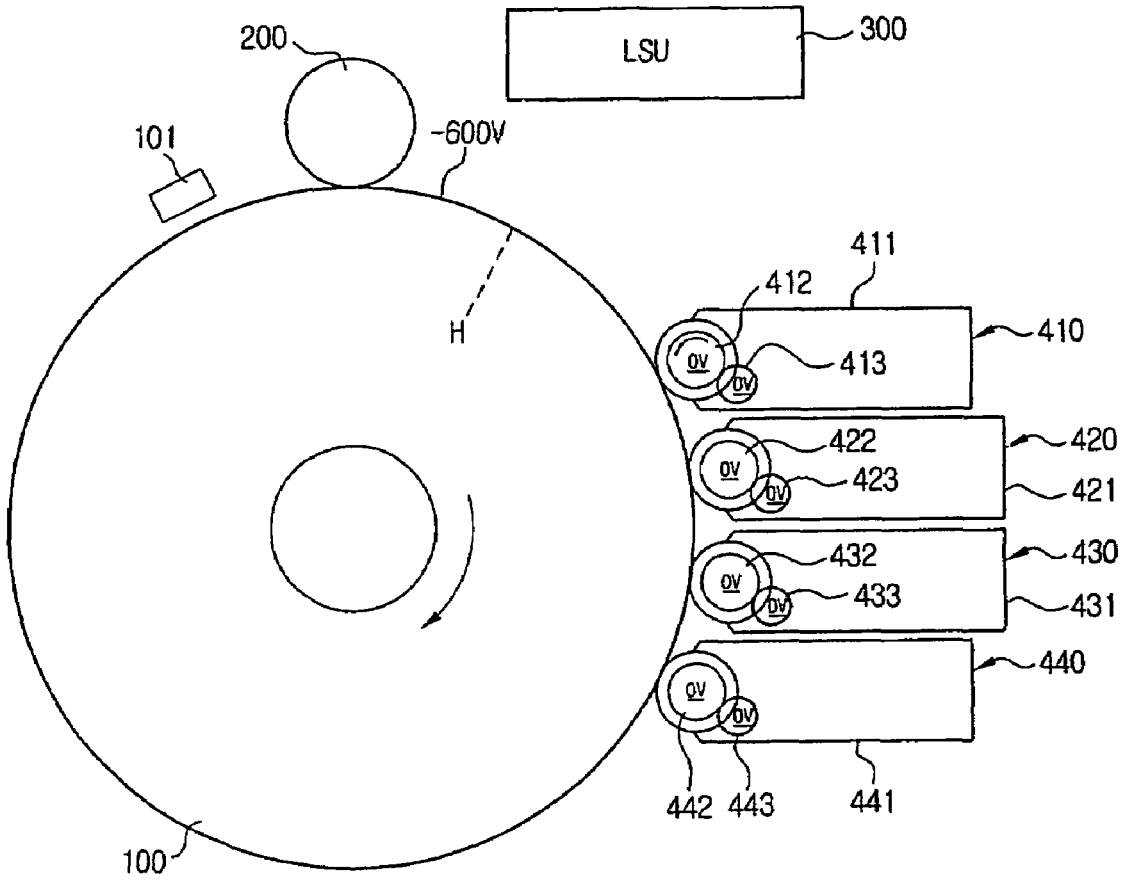
Figure 4C:
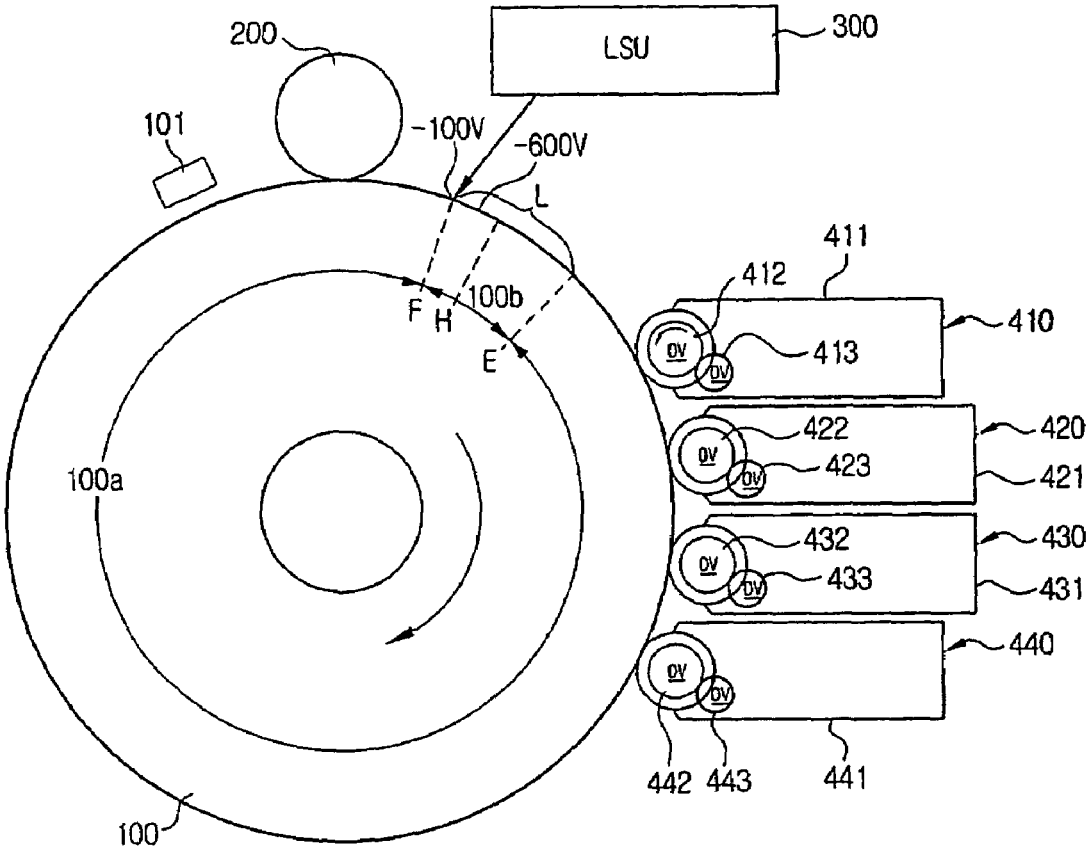
Figure 4D:
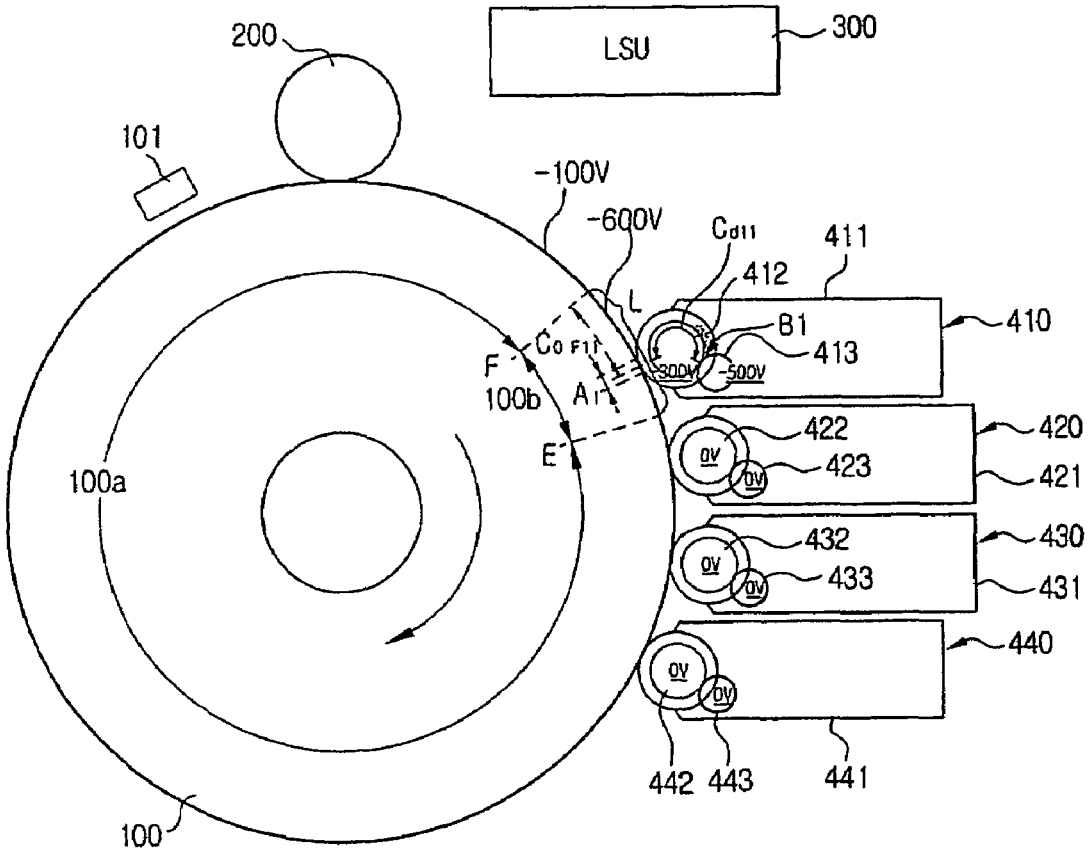

For example, as shown in FIG. 4D, the controlling apparatus 800 controls the voltage supplying apparatus 700 such that only the first developing apparatus 410 adheres toner to the image area 100*a* of the photoconductive medium 100.

At this time, if the bias voltages applied to the developing roller and the supplying roller of the developing apparatus in operation are defined by Vd and Vs, respectively, the controlling apparatus 800 controls the voltage supplying apparatus 700 to satisfy the following equation during the developing operation:

$$|Vd|<|Vs| \qquad \text{[Equation 1]}$$

According to equation 1, a toner is supplied from the first supplying roller 413 to the first developing roller 412. At this time, a voltage applied to the developing roller 412 and the first supplying roller 413 is referred to as a positive bias voltage.

If a circular length of the first developing roller 412 from a center of the first toner supply area B1 to a center of the first developing area A1 in a rotation direction of the first developing roller 412 as shown in FIG. 3B is denoted by $C_d$ and if a circular length of the photoconductive medium 100 from a starting point F of the image area 100*a* to the center of the first developing area A1 in a rotation direction of the photoconductive medium 100 is denoted by $C_{0\cdot F}$, the controlling apparatus 800 controls the voltage supplying apparatus 700 to satisfy equation 1 from a time when the following equation is satisfied:

$$C_{0\cdot F}=(C_d+\alpha_1\cdot L)\cdot(So/Sd),\ 0\leqq\alpha_1<0.5 \qquad \text{[Equation 1-1]}$$

wherein L denotes an arc length of the non-image area 100*b*, So denotes a normal velocity of the circumference of the photoconductive medium 100, Sd denotes a normal velocity of the circumference of the developing roller, and $\alpha_1$ denotes a real number.

In this embodiment, So and Sd have the same value. Accordingly, (So/Sd) equals 1.

The reason for controlling as described above is that the image area 100*a* is supplied with the toner T1 from the first developing roller 412 when the starting point F of the image area 100*a* passes the first developing area A1 as the photoconductive medium 100 rotates. At this time, an amount of toner corresponding to the length of $(\alpha_1\cdot L)\cdot(So/Sd)$ is prepared on the first developing roller 412 in advance such that a stable developing operation can be accomplished.

More specifically, since the length $C_{0\cdot F}$, of the photoconductive medium 100 is longer than the length $C_d$ of the first developing roller 412 by $(\alpha_1\cdot L)\cdot(So/Sd)$, the toner T1, which is initially supplied from the first developing roller 412 by the supply of a positive bias voltage, passes the first developing area A1 in advance by as much as $(\alpha_1\cdot L)\cdot(So/Sd)$. After that, when the photoconductive medium 100 further moves by $(\alpha_1\cdot L)\cdot(So/Sd)$, the electrostatic latent image on the image area 100*a* is stably developed by the toner T1 which is supplied from the developing roller 412 in advance.

A condition for a stable supply of a toner is satisfied by controlling the time when the positive bias voltage is supplied according to equation 1-1. In certain circumstances, the positive bias voltage may be supplied earlier than the time satisfying equation 1-1. For example, when the first developing apparatus 410 initially operates, the controlling apparatus 800 controls the first developing apparatus 410 not to interfere with the other developing apparatuses 420, 430, 440 and supply the positive bias voltage between the first developing roller 412 and the first supplying roller 413 before an electrostatic latent image is formed on the photoconductive medium 100.

Figure 4E:
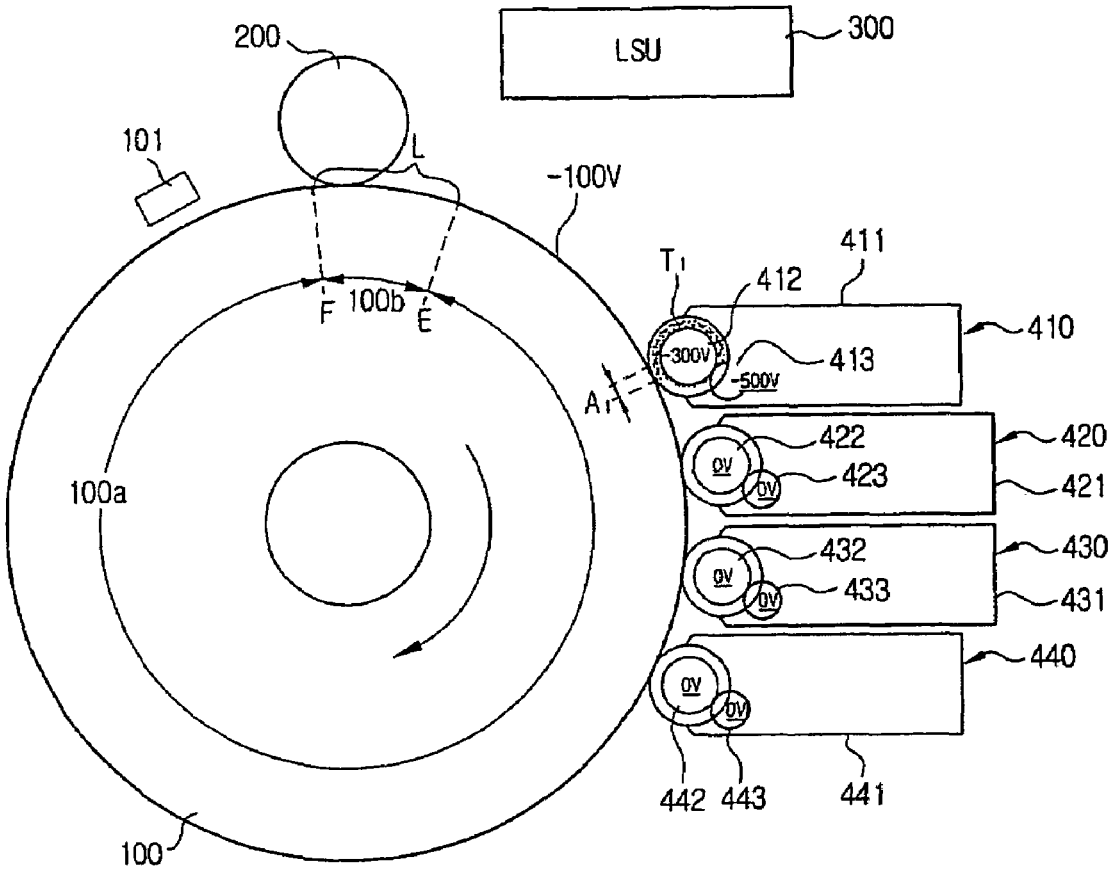
Figure 4F:
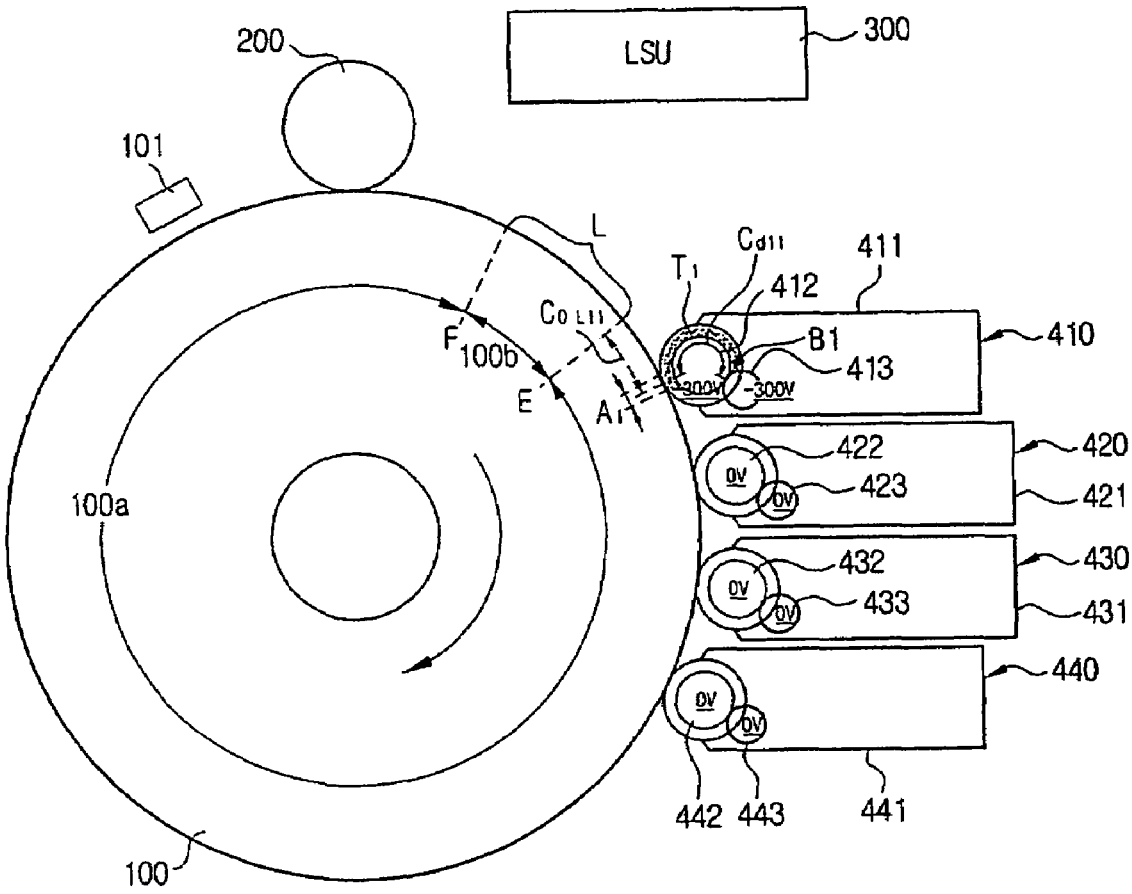

After controlling a certain time to satisfy equation 1 as shown in FIG. 4E, the controlling apparatus 800 controls the voltage supplying apparatus 700 to satisfy equation 2 as shown in FIG. 4F:

$$|Vd|=|Vs| \quad \text{[Equation 2]}$$

wherein, the absolute values of Vd and Vs are greater than an absolute value of an electric potential of an electrostatic latent image area of the image area 100*a* which is formed by the laser scanning unit 300. At this time, a voltage supplied between the first developing roller 412 and the first supplying roller 413 is referred to as a neutral bias voltage.

If a circular length of the photoconductive medium 100 from an ending point E of the image area 100*a* to the center of the first developing area A1 in a rotation direction of the photoconductive medium 100 is denoted by $C_{0\cdot L}$, the controlling apparatus 800 controls the voltage supplying apparatus 700 to satisfy equation 2 from a time when the following equation is satisfied:

$$C_{0\cdot L}=(C_d-\alpha_2\cdot L)\cdot(So/Sd),\ 0\leqq\alpha_2<0.5 \quad \text{[Equation 2-1]}$$

The toner is sufficiently supplied to the first developing roller 412 by the positive bias voltage until equation 2-1 is satisfied.

Since the circular length $C_{0\cdot L}$ of the photoconductive medium 100 is shorter than the circular length $C_d$ of the developing roller by $(\alpha_2\cdot L)\cdot(So/Sd)$, the end portion of the toner T1 supplied to the first developing roller 412 by the positive bias voltage further moves from the ending point E of the image area 100*a* by $(\alpha_2\cdot L)\cdot(So/Sd)$ and finally reaches the photoconductive medium 100.

A developing operation can be performed if the toner T1 is supplied only to the ending point E of the image area 100*a*. However, according to this embodiment of the present invention, the toner T1 is further supplied beyond the ending point E of the image area 100*a* by $(\alpha_2\cdot L)\cdot(So/Sd)$ such that the toner T1 can be more stably supplied to the image area 100*a*.

Figure 4G:
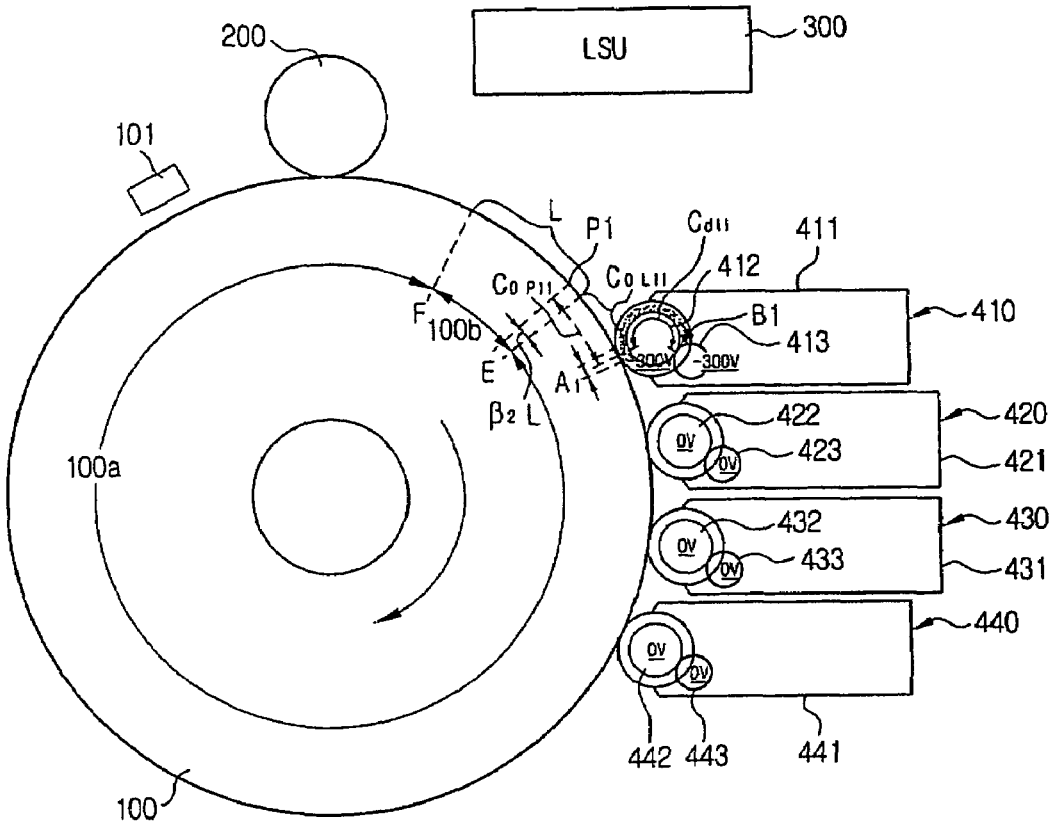
Figure 4H:
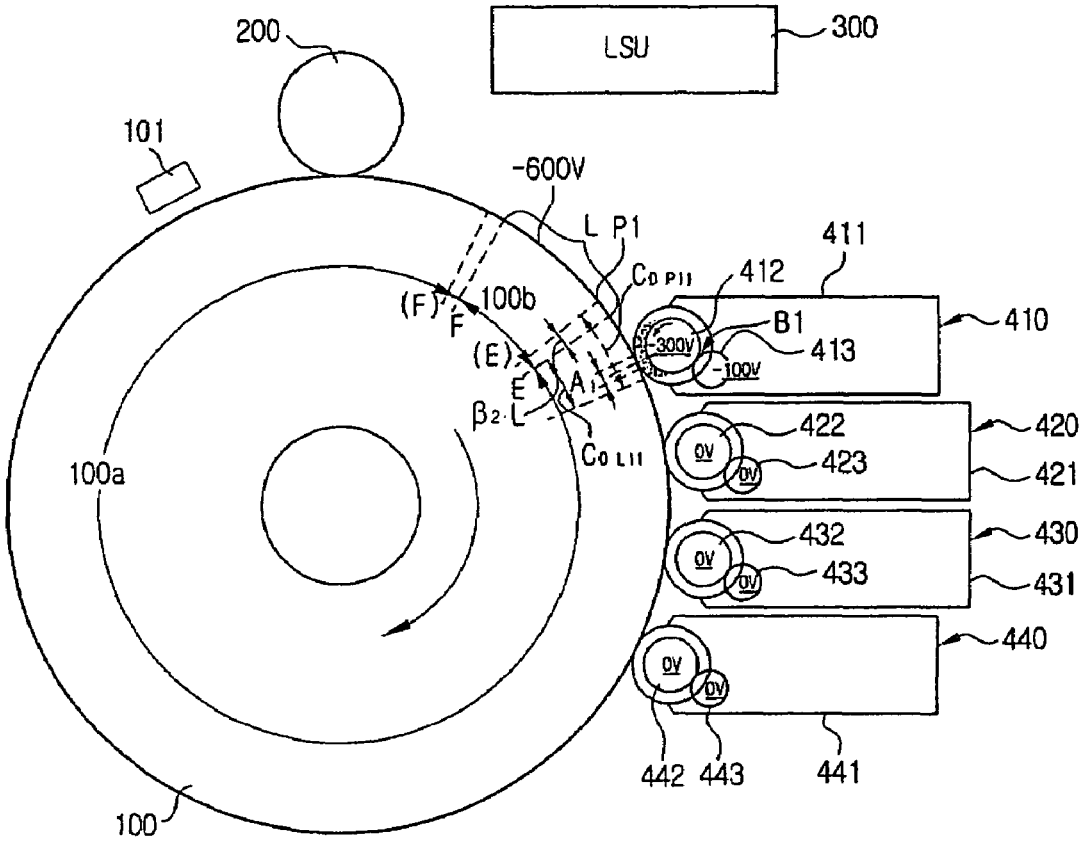

After controlling a certain time to supply a bias voltage to satisfy equation 2, as shown in FIG. 4H, the controlling apparatus 800 controls the voltage supplying apparatus 700 to satisfy the equation 3:

$$|Vd|>|Vs| \quad \text{[Equation 3]}$$

If equation 3 is satisfied, the toner T1, which moves from the first supplying roller 413 to the first developing roller 412 by the positive bias voltage, is collected on the first supplying roller 413 due to a voltage difference. That is, the toner T1, which is not in use for the developing operation and remains in the first developing roller 412, is collected on the first supplying roller 413. At this time, a voltage applied to the first supplying roller 413 and the first developing roller 412 is referred to as a reverse bias voltage.

As shown in FIG. 4G, if with reference to a point of time satisfying equation 2-1, a circular length of the photoconductive medium 100 from a first position P defined by equation 3-1 as follows to the center of the first developing area A1 in a rotation direction of the photoconductive medium 100 is denoted by $C_{0\cdot P1}$, the controlling apparatus 800 controls a timing of applying the reverse voltage based on the equation 3-1:

$$C_{0\cdot P1}=\{C_d-(\alpha_2-\beta_2)\cdot L\}\cdot(So/Sd),$$

$$0\leqq\alpha_2<0.5,$$

$$0\leqq\beta_2<0.5 \quad \text{[Equation 3-1]}$$

That is, the controlling apparatus 800 controls the voltage supplying apparatus 700 to supply the neutral bias voltage for a certain time from the time when equation 2-1 is satisfied, and then, controls the voltage supplying apparatus 700 to supply the reverse bias voltage when the photoconductive medium 100 is further rotated from the time satisfying equation 2-1 by $(\beta_2\cdot L)\cdot(So/Sd)$, which is a difference between the circular lengths $C_{0\cdot L}$ and $C_{0\cdot P1}$, as shown in FIG. 4H.

In FIGS. 4H, (F) and (E) represent a non-image area at the initial point of time satisfying the equation 2-1 to indicate a relationship between this initial point of time and the circular length $C_{0\cdot P2}$, respectively.

Accordingly, since the toner T1 is sufficiently supplied to the image area 100*a* and the remaining toner T1 is collected on the first supplying roller 413, unnecessary waste of toner is prevented and the remaining toner T1 is prevented from contaminating developing apparatuses 420, 430 or 440 performing a subsequent developing operation.

After the reverse bias voltage is applied for a certain time, the neutral bias voltage may be again applied to the first developing roller 412 and the first supplying roller 413 or the voltage supply may be stopped. Subsequently, a different color developing operation is accomplished in the subsequent developing apparatuses 420, 430 or 440.

The toner collecting operation performed based on equation 3 may be performed by at least one of the second to fourth developing apparatuses 420, 430, 440 which are not performing developing.

Figure 4I:
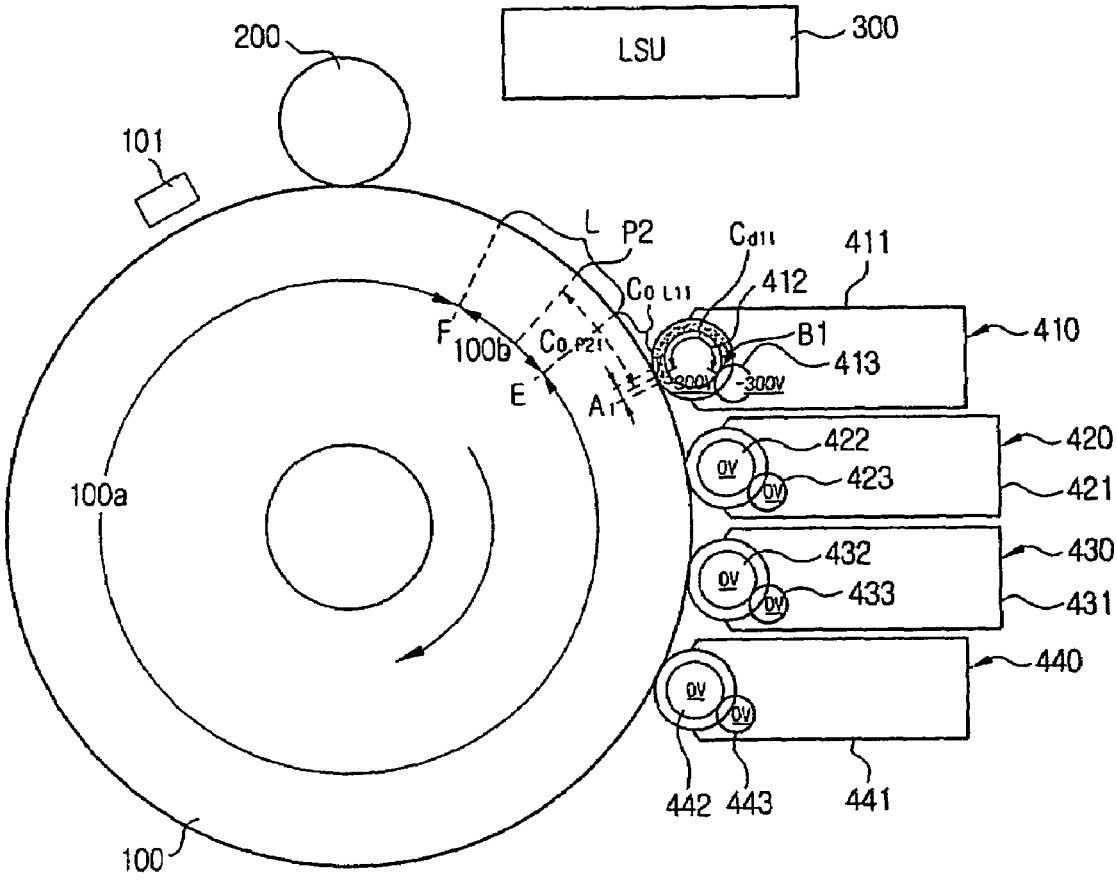
Figure 4J:
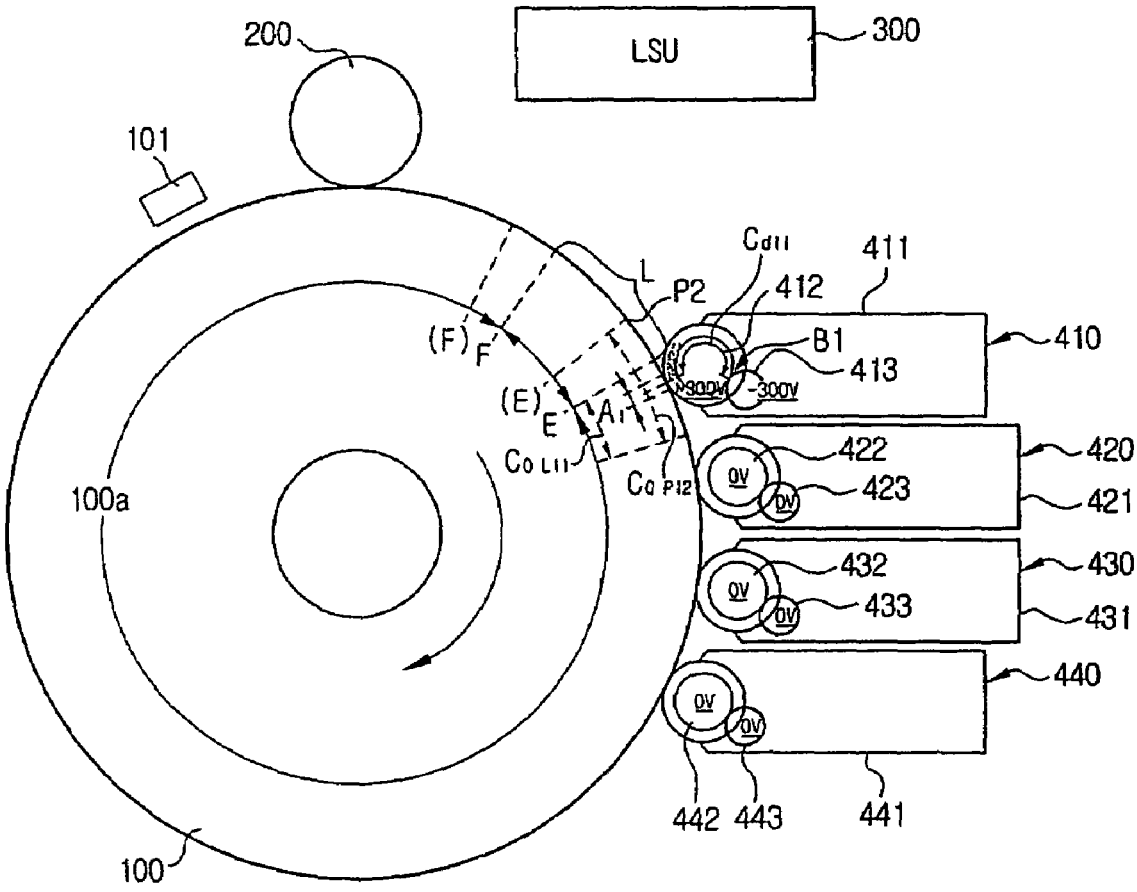

As shown in FIGS. 4I and 4J, if, with reference to the point of time satisfying equation 2-1, a circular length of the photoconductive medium 100 from a second position P2 of the non-image area 100*b* defined by equation 2-2 as follows to the center of the first developing area A1 in the rotation direction of the photoconductive medium 100 is denoted by $C_{0\cdot P2}$, and if the second position P2 further moves from the initial point of the circular length $C_{0\cdot L}$ satisfying equation 2-1 by a difference between the circular lengths $C_{0\cdot L}$ and $C_{0\cdot P2}$, the controlling apparatus 800 controls the voltage supplying apparatus 700 to supply the neutral bias voltage or stop the voltage supply:

$$C_{0\cdot P2}=[C_d+\{1-(\alpha_1+\beta_2+2\alpha_2)\}\cdot L]\cdot(So/Sd),$$

$$0\leqq\alpha_1<0.5,$$

$$0\leqq\beta_1<0.5,$$

$$0\leqq\alpha_2<0.5 \quad \text{[Equation 2-2]}$$

The circular lengths $C_{0\cdot L}$, $C_{0\cdot P1}$, and $C_{0\cdot P2}$ are defined with reference to the same point of time satisfying equation 2-1. More specifically, when the last end of the circular length $C_{0\cdot L}$, that is, the ending point E of the image area 100*a* satisfies equation 2-1, the supply of the positive bias voltage is stopped and the neutral bias voltage is supplied. When the last end of the circular length $C_{0\cdot P1}$ satisfying equation 3-1 further moves from the initial point of time satisfying equation 2-1 by a predetermined distance $(\beta_2\cdot L)$, the supply of the neutral bias voltage is stopped and the reverse bias voltage is supplied. As shown in FIG. 4J, when the last end of the circular length $C_{9\cdot P2}$ satisfying equation 2-2 further moves from the initial point of time satisfying equation 2-1 by a predetermined distance $\{1-(\alpha_1+\beta_1+\alpha_2)\}\cdot L$, the supply of the reverse bias voltage is stopped and the neutral bias voltage is supplied or the voltage supply is stopped.

Like those of FIGS. 4H, (F) and (E) of FIG. 4J represent a non-image area at the initial point of time satisfying equation 2-1 to indicate a relationship between the initial point of time satisfying equation 2-1 and the circular length $C_{0\cdot P2}$ of equation 2-2.

Although in this embodiment, the neutral bias voltage is applied or the voltage supply is stopped after the positive, the neutral, and the reverse bias voltages are applied, this should not be considered as limiting. After the application of the positive bias voltage, the neutral bias voltage is applied or the voltage supply is stopped, or after the application of the positive bias voltage and the reverse bias voltage, the neutral bias voltage is applied or the voltage supply is stopped. In these cases, equations 1 to 3-1 are properly used.

In this embodiment, the circular lengths $C_{0\cdot F}$, $C_{0\cdot L}$, $C_{0\cdot P1}$, and $C_{0\cdot P2}$ of the photoconductive medium 100 start from the center of the first developing area A1 as shown in FIGS. 4D to 4J. In the same way, the circular length $C_d$ of the first developing roller 412 is a circular length between the centers of the first developing area A1 and the first toner supply area B1 along the rotation direction. This is to more accurately control the timing of applying the positive, neutral and reverse bias voltages.

Hereinafter, the operation of the image forming apparatus according to the first embodiment of the present invention will now be described with reference to FIGS. 4A to 6. When the image forming operation begins, the photoconductive medium 100 is rotated at a certain speed, as shown in FIG. 4A. When the home sensor 101 detects the home position H on the photoconductive medium 100, the controlling apparatus 800 is informed. After a predetermined time, the controlling apparatus 800 then controls the electrifying apparatus 200 to electrify the photoconductive medium 100 to a predetermined electric potential such as −600V, as shown in FIG. 4B.

As shown in FIG. 4C, the electrified surface of the photoconductive medium 100 is scanned by the laser beams irradiated from the laser scanning unit 300 to a predetermined laser scanning potential such as −100V, and therefore, a first electrostatic latent image is formed for a color image.

The controlling apparatus 800 controls the voltage supplying apparatus 700 so that a positive bias voltage is supplied between the first supplying roller 413 and the first developing roller 412 according to equation 1 to perform the developing operation of the first developing apparatus 410. For example, −500V and −300V are applied to the first supplying roller 413 and the first developing roller 412, respectively.

As shown in FIG. 4D, when the starting point F of the image area 100*a* is spaced from the first developing area A1 by a predetermined distance to satisfy equation 1-1, the positive bias voltage is applied between the first supplying roller 413 and the first developing roller 412 based on the equation 1.

In equation 1-1, $\alpha_1$ denotes a safety factor that is given to allow the toner T1 initially supplied to the developing roller 412 by the positive bias voltage to move and meet the photoconductive medium 100 ahead of the starting point F of the image area 100*a* by a predetermined distance.

That is, a value obtained by equation 1-1 is to control the toner T1 supplied to the developing roller 412 by the positive bias voltage to meet the non-image area 100*b* ahead of the starting point F of the image area 100*a* by $\alpha_1 \cdot L$ and thus to achieve a stable developing operation with a stable supply of toner T1.

In this embodiment, $\alpha_1$ is set to 0.1. However, this should not be considered as limiting $\alpha_1$ has a variable value in the range of the equation 1-1.

When the supplied positive bias voltage is determined by equation 1-1, i.e., by multiplying the circular length L of the non-image area 100*b* by 0.1 and adding the circular length $C_{d11}$ of the first developing roller 412 from the center of the first toner supply area B1 to the center of the first developing area A1 to the multiplying result, and then multiplying the addition result by the normal velocity ratio (So/Sd) of the photoconductive medium 100 and the first developing roller 412, i.e., 1.

More specifically, as shown in FIG. 4D, the positive bias voltage is supplied to the first supplying roller 413 and the first developing roller 412 when the starting point F of the image area 100*a* of the photoconductive medium 100 reaches the last end of the circular length $C_{0\cdot F11}$ before reaching the center of the first developing area A1, i.e., when the starting point F of the image area 100*b* satisfies equation 1-1. Since the circular length $C_{0\cdot F11}$ of the photoconductive medium 100 to indicate the point of time when the positive bias voltage is supplied, is longer than the circular length $C_{d\cdot 11}$ by $(0.1\cdot L)\cdot 1$, the toner T1 is supplied ahead of the starting point F of the image area 100*a* by $(0.1\cdot L)\cdot 1$.

Accordingly, the toner can be sufficiently and stably supplied from the first supplying roller 413 to the electrostatic latent image of the image area 100*a* through the first developing roller 412.

In this case, since there is no bias voltage interference caused by another developing apparatus, the positive bias voltage may be supplied in advance without satisfying equation 1-1. That is, the positive bias voltage may be supplied between the first supplying roller 413 and the first developing roller 412 before an electrostatic latent image is formed on the photoconductive medium 100. Herein, equation 1-1 to control a timing of applying the bias voltage is a minimum safety condition for guaranteeing the stable electrostatic latent image formation.

When the positive bias voltage is applied, the yellow toner T1 stored in the first toner receptacle 411 is negatively electrified by the first supplying roller 413 and thus adhered onto the surface of the first developing roller 412. As a result, a toner layer is formed on the surface of the first developing roller 412. When the electrostatic latent image of the photoconductive medium 100 approaches the first developing area $A_1$, the yellow toner T1 of the first developing roller 412 is adhered onto the electrostatic latent image which has a lower electric potential than the first developing roller 412, and accordingly, a yellow image is formed.

Meanwhile, the controlling apparatus 800 controls the voltage supplying apparatus 700 to stop the voltage supply to the second through the fourth developing apparatuses 420, 430, 440 while the first developing apparatus 410 performs the developing operation.

As shown in FIG. 4E, the positive bias voltage is supplied between the first supplying roller 413 and the first developing roller 412 when the developing operation is performed with respect to the image area 100*a* until the neutral bias voltage is supplied based on equation 2.

As shown in FIG. 4F, the neutral bias voltage satisfying equation 2 is supplied between the first supplying roller 413 and the first developing roller 412 from a time when a leading end of the section $C_{0\cdot L11}$, which is obtained by subtracting $\alpha_2 \cdot L$ from the circular length $C_{d\cdot 11}$ and multiplying the subtraction result by (So/Sd), i.e., 1 according to equation 2-1, passes the first developing area A1. Herein, $C_{0\cdot L11}$ denotes a circular length of the photoconductive medium 100 from the ending point E of the image area 100*a* to the center of the first developing area A1 in a rotation direction of the photoconductive medium 100.

Herein, $\alpha_2$ is set to 0.1 like $\alpha_1$, and the neutral bias voltage supplied to the first supplying roller 413 and the first developing roller 412 based on equation 2 is −300V, an absolute value of which is greater than that of the voltage of the electrostatic latent image, such as −100V.

The neutral bias voltage is applied between the first supplying roller 413 and the first developing roller 412 such that the yellow toner T1 is not adhered to the first developing roller 412 any longer. Also, the yellow toner T1, which is already adhered to the first developing roller 412 by the circular length $C_{d\cdot 11}$, is supplied to the section $C_{0\cdot L11}$, which is shorter than the circular length $C_{d\cdot 11}$ by (0.1·L)·1, and develops the electrostatic latent image of −100V.

Herein, the toner T1, which is already adhered to the first developing roller 412 and corresponds to (0.1·L)·1 meets the non-image area 100*b* of the photoconductive medium 100 such that it is not used in developing the image and remains as spare toner. Accordingly, the toner T1 is sufficiently supplied in developing the image area 100*a*.

In equations 1-1 and 2-1, $\alpha_1$ and $\alpha_2$ represent a safe factor of the toner T, which is necessary to sufficiently supply the toner T to the electrostatic latent image of the image area 100*a*.

As described above, the developing operation of the first developing apparatus 410 is completed within the image area 100*a* of the photoconductive medium 100 by performing a first supplying operation of supplying the positive bias voltage to the first supplying roller 413 and the first developing roller 412 and a second supplying operation of supplying the neutral bias voltage.

As shown in FIG. 4H, the reverse bias voltage is applied between the first supplying roller 413 and the first developing roller 412 based on equation 3 when the last end of the circular length $C_{0\cdot P11}$, which is obtained with reference to the timing of supplying the neutral bias voltage, further moves from the initial point ((F) and (E) in FIG. 4) of the circular length $C_{0\cdot L11}$ obtained by the equation 2-1 by a predetermined distance ($\beta_2$·L). The reverse bias voltage being supplied as determined by equation 3-1 is shown in FIG. 4G. Herein, $\beta_2$ is set to 0.15.

When the first position P1 defined by equation 3-1 further moves by a predetermined distance (0.15·L)·1 which corresponds to a difference between the circular lengths $C_{0\cdot L11}$ and $C_{0\cdot P11}$, the reverse bias voltage is applied.

That is, when the ending point E of the image area 100*a* further rotates by (0.15·L)·1 from a time when equation 2-1 is satisfied and the reverse bias voltage is supplied, the reverse bias voltage is supplied.

Meanwhile, $\alpha_2$ and $\beta_2$ are properly adjusted such that the reverse bias voltage is supplied before the image area 100*a* passes the whole section of the first developing area A1 or the neutral bias voltage or the reverse bias voltage is supplied after the positive bias voltage is supplied.

As shown in FIG. 4H, the reverse bias voltages supplied the first developing roller 412 and the first supplying roller 413 are −300V and −100V, respectively, by way of an example.

As described above, when the reverse bias voltage is supplied between the first supplying roller 413 and the first developing roller 412, the toner T1 which remains on the surface of the first developing roller 412 after the developing operation is collected on the first supplying roller 413 having a lower electric potential.

When the first developing operation is completed as described above, the bias voltage supplied to the first developing apparatus 410 is stopped or the neutral bias voltage is supplied. Then, a subsequent developing apparatus performs a developing operation. The yellow image formed on the photoconductive medium 100 by the first developing apparatus 410 is transferred to the transfer belt 501 by the first transfer roller 502.

FIGS. 4I and 4J illustrate the time at which the neutral bias voltage is supplied or the voltage supply is stopped after the reverse bias voltage is supplied.

Referring to FIG. 4I, when the last end of the circular length $C_{0\cdot P21}$ of the photoconductive medium 100, which is obtained by equation 2-2, further moves from the initial point satisfying equation 2-1 as shown in FIG. 4J by a predetermined distance $\{1-(\alpha_1+\beta_1+\alpha_2)\}\cdot L$, the neutral bias voltage is supplied or the voltage supply is stopped. In equation 2-2, $\beta_1$ is set to 0.15, as is $\beta_2$.

The circular length $C_{0\cdot P21}$ is obtained by adding (1−0.45)·L, i.e., 0.55·L to $C_{d\cdot 11}$ and multiplying the result of this addition by (So/Sd), i.e., 1. Herein, 0.45 indicates ($\alpha_1+\beta_1+2\alpha_2$).

The circular lengths of the image area 100*a* and the non-image area 100*b* are not limited to the values shown in the drawings, and if necessary, can be variable. Accordingly, by properly adjusting $\alpha_1$, $\beta_1$, $\alpha_2$, and $\beta_2$ in equations 1 to 3-1 according to the lengths of the image area 100*a* and the non-image area 100*b*, the timing of applying the positive, neutral, and reverse bias voltages is properly controlled.

After the developing operation performed by the first developing apparatus 410 is completed, the home sensor 101 detects the home position H of the photoconductive medium 100 as shown in FIG. 4A in order to perform a developing operation of the second developing apparatus 420.

However, this should not be considered as limiting. A subsequent developing apparatus performs a developing operation based on the information about the initially detected home position H without detecting the home position again.

After that, a new electrostatic latent image is formed on the photoconductive medium 100 through the processes of electrifying by the electrifying apparatus 200 and laser scanning by the laser scanning unit 300 as shown in FIGS. 4B and 4C.

Figure 5A:
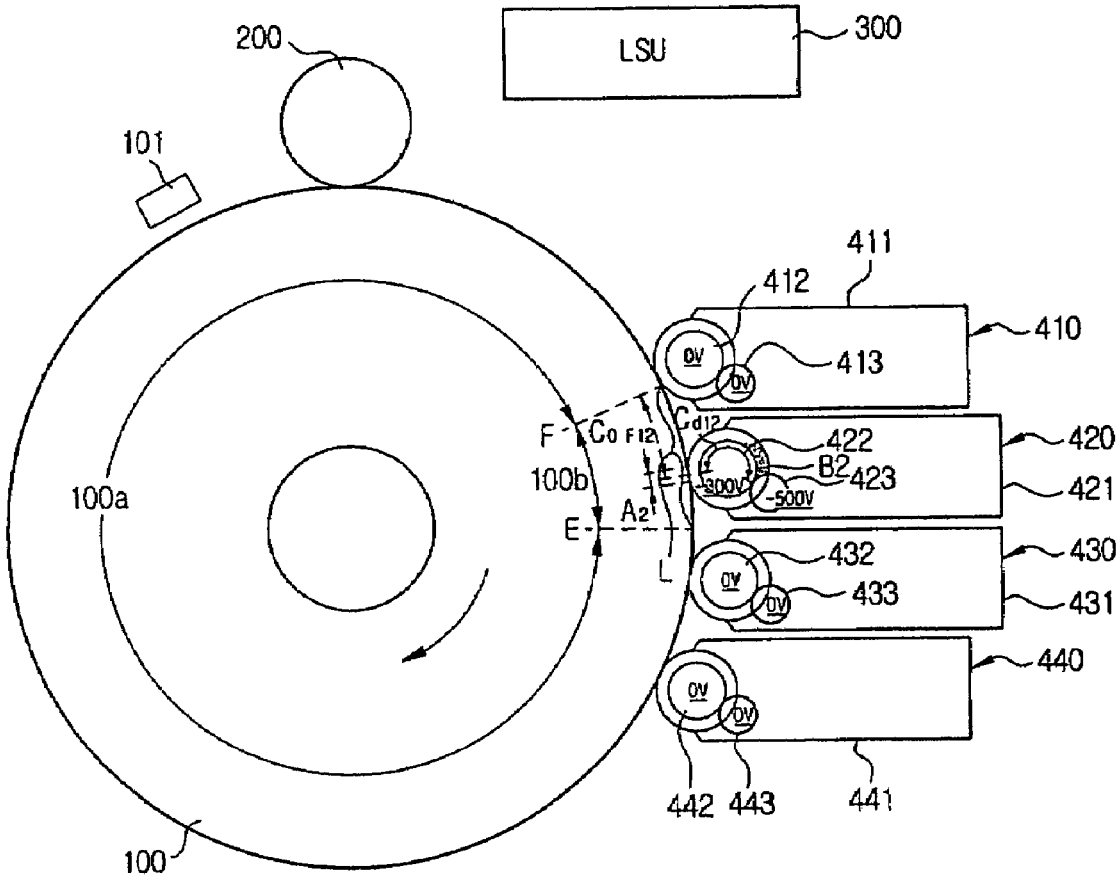

As shown in FIG. 5A, a positive bias voltage is supplied between the second supplying roller 423 and the second developing roller 422 from a time when a circular length $C_{0\cdot F12}$ of the photoconductive medium 100 from a starting point F of the image area 100*a* to a center of a second developing area A2 satisfies equation 1-1. In FIG. 5A, the circular length $C_{d12}$ of the second developing roller 422 is measured from the center of the second toner supply area B2 to the center of the first developing area A2.

More specifically, as in the case of the first developing apparatus 410, −500V and −300V are supplied to the second supplying roller 423 and the second developing roller 422, respectively. Accordingly, a magenta toner T2 stored in the second toner receptacle 421 moves from the second supplying roller 423 to the second developing roller 422 having a low absolute value of electric potential.

Figure 5B:
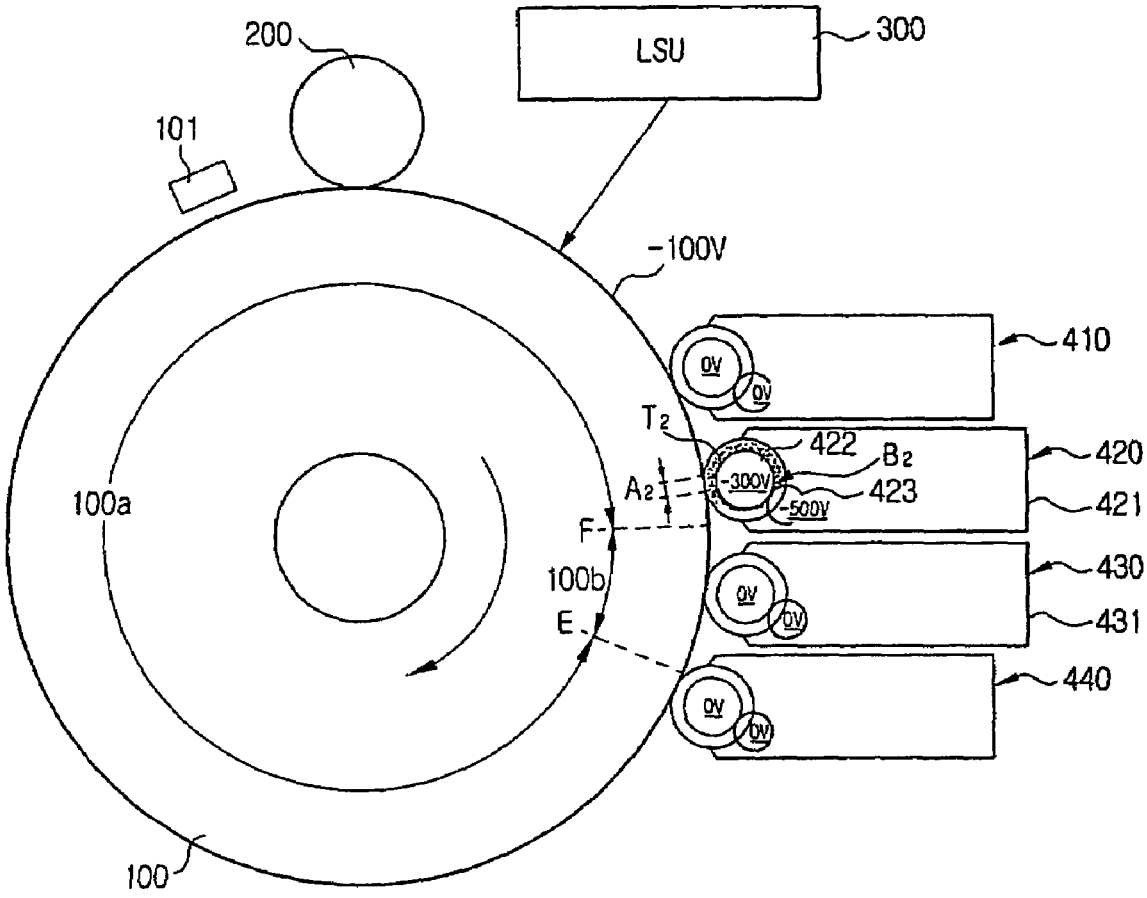

As shown in FIG. 5B, when the image area 100*a* passes the second developing area A2, the magenta toner T2 on the second developing roller 422 moves to an electrostatic latent image having a low absolute value of electric potential, such as −100V, through the second developing area A2, and thereby forms a magenta image. The magenta image is transferred to the transfer belt 501 by the first transfer roller 502 and is overlapped with the yellow image transmitted by the first developing apparatus 410 on the transfer belt 501.

In the same manner as the first developing apparatus 410, the neutral bias voltage and the reverse bias voltage are supplied between the second supplying roller 423 and the second developing roller 422 of the second developing apparatus 420 based on equations 2 to 3-1 in order, and then, the neutral bias voltage is again applied or the voltage supply is stopped.

Figure 5C:
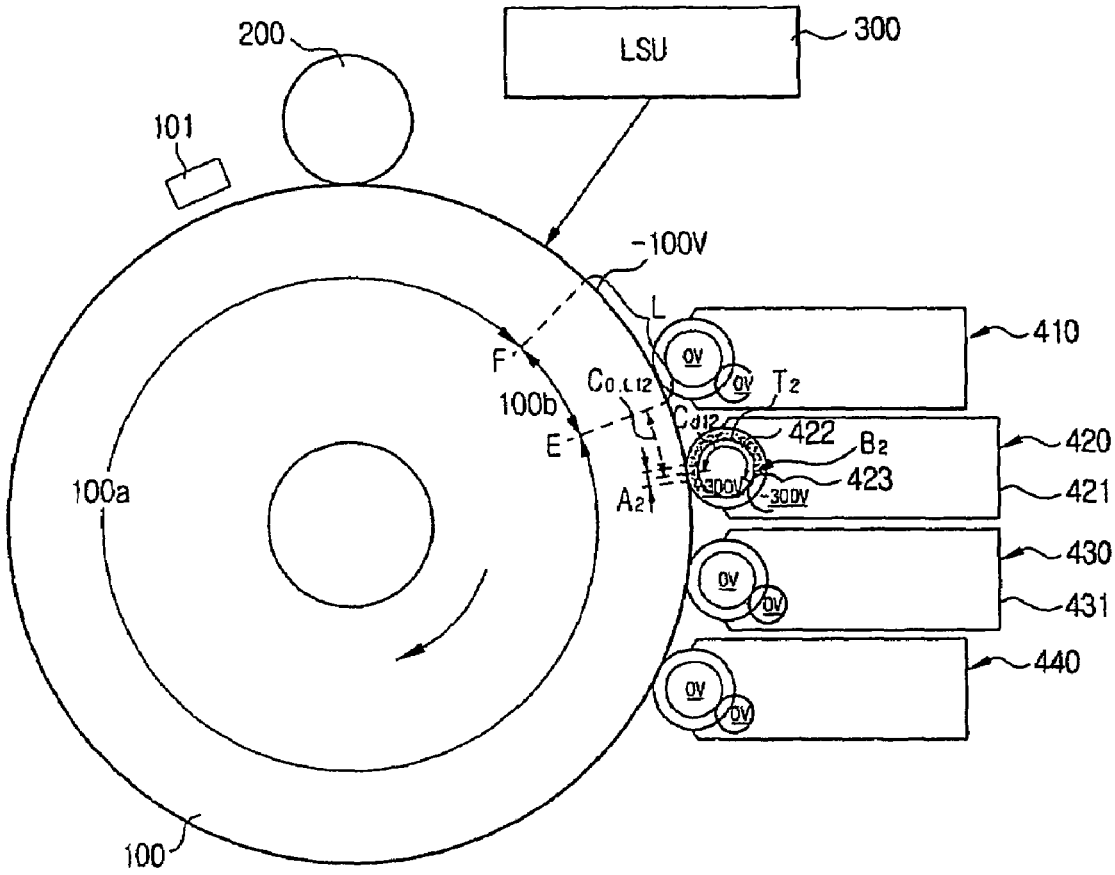
Figure 5D:
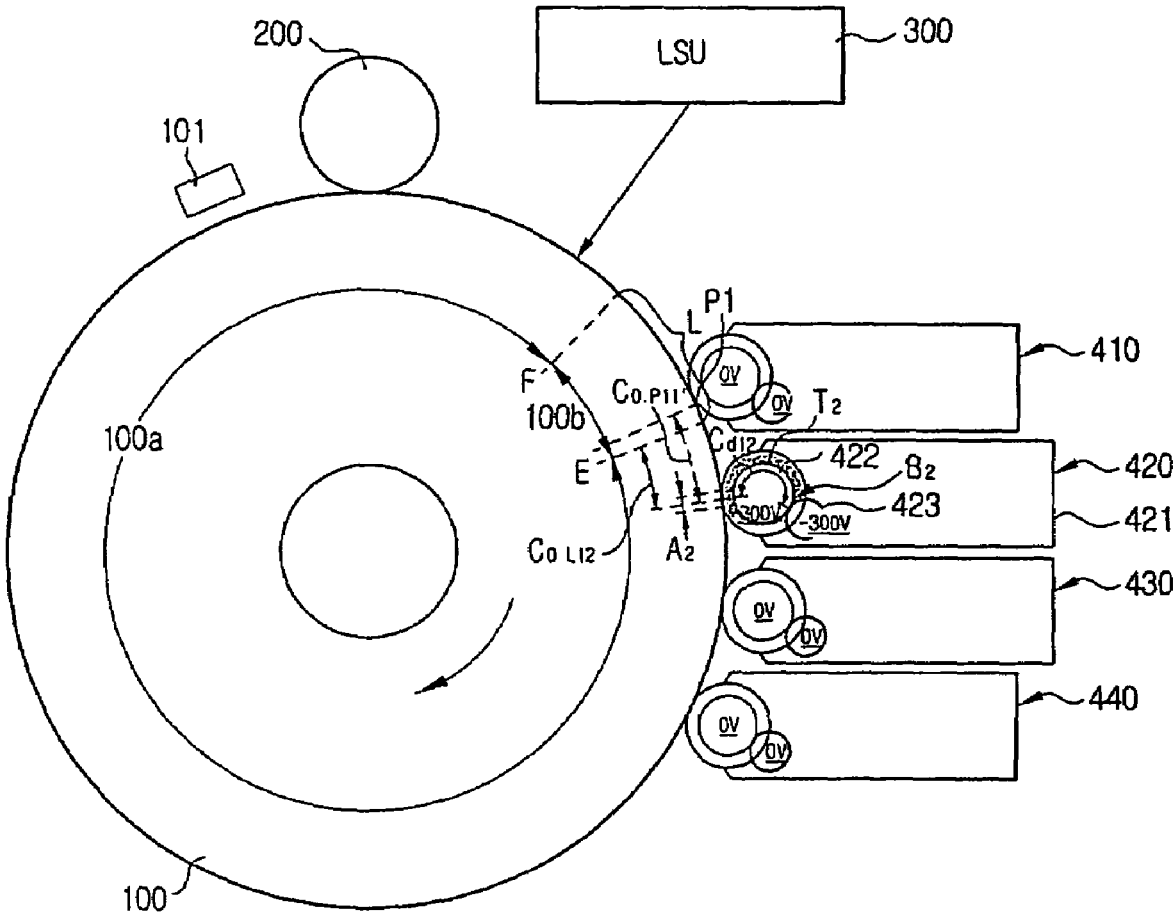
Figure 5E:
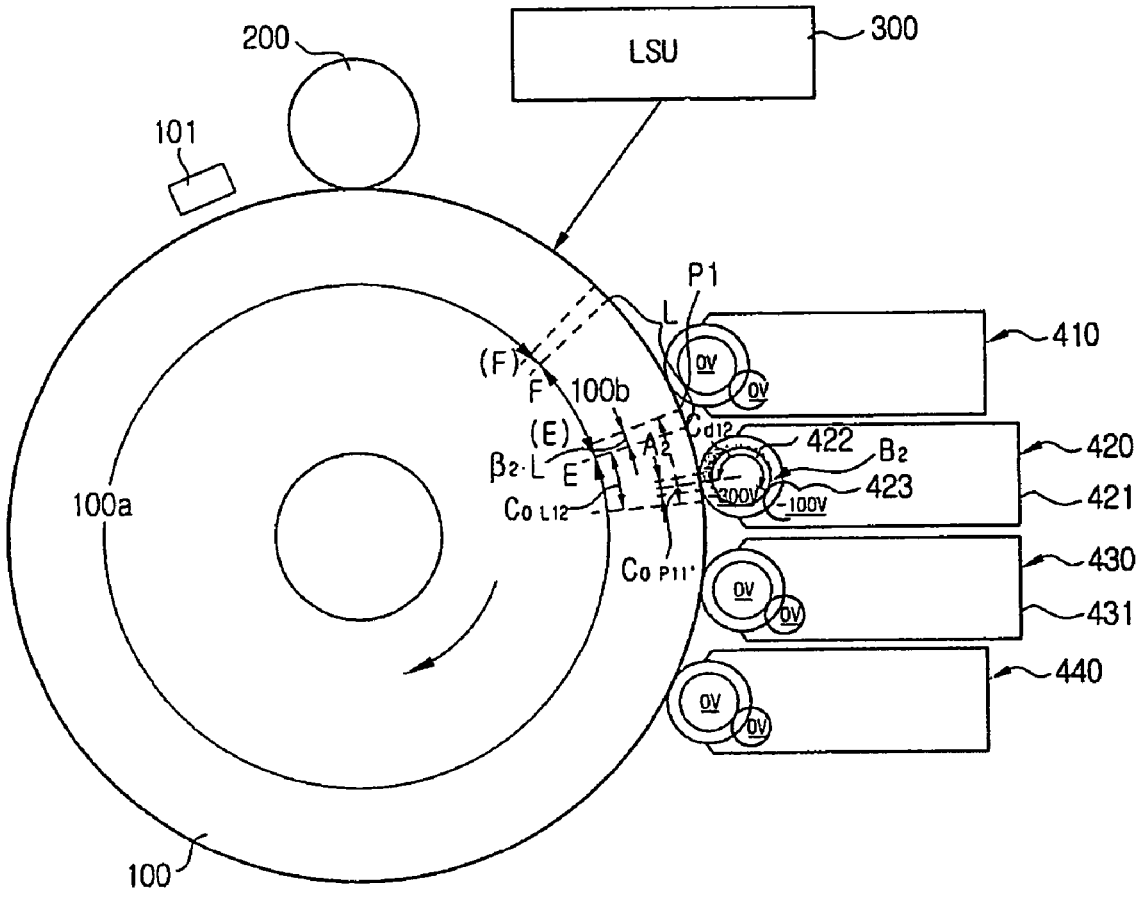

More specifically, after the neutral bias voltage is supplied between the second supplying roller 423 and the second developing roller 422 based on equations 2 and 2-1 as shown in FIG. 5C, the revere bias voltage is supplied based on equations 3 and 3-1 as shown in FIGS. 5D and 5E. In FIG. 5C, the circular length $C_{0\cdot L12}$ of the photoconductive medium 100 is measured from the beginning of the non-image area 100*b* to the center of the second toner supply area B2. At this time, the neutral bias voltage and the reverse bias voltage supplied to the second supplying roller 423 and the second developing roller 422 have the same value as those of the first developing apparatus 410.

In another embodiment, after the reverse bias voltage is supplied between the second supplying roller 423 and the second developing roller 422, the voltage supplying apparatus 700 supplies the neutral bias voltage instead of stopping the voltage supply. At this time, the timing of stopping the voltage supply or applying the neutral bias voltage is determined by equation 2-2.

The above-described developing operation is accomplished in the third and the fourth developing apparatuses 430, 440. When the developing operations of the third and the fourth developing apparatuses 430, 440 are completed, a cyan image and a black image are transferred to the transfer belt 501 in order such that a color image which is an overlap of four colors of toner images is formed on the transfer belt 501.

The color image is transferred by the second transfer roller 503 to the printing paper P which is fed from the paper cassette 900, and then adhered to the paper P which is passed through the fusing unit 600.

Figure 6:
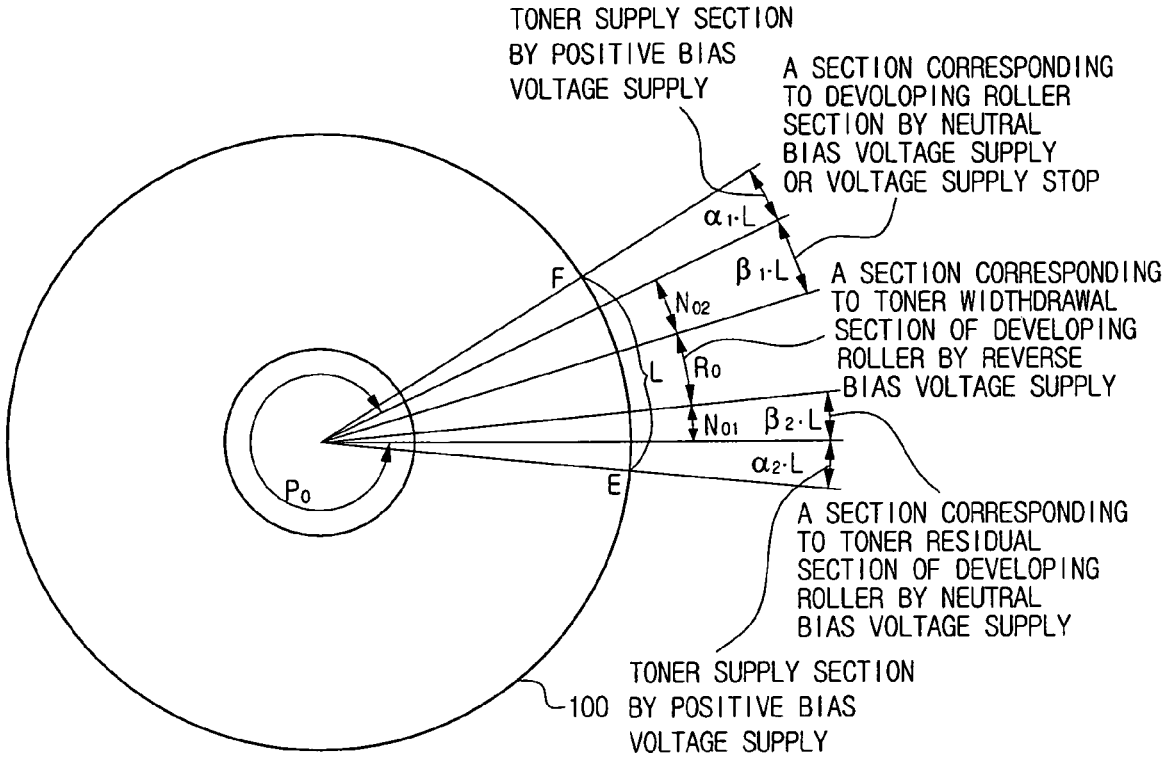
FIG. 6 shows sections of a photoconductive medium supplied with a toner from a developing unit with reference to absolute coordinates of the photoconductive medium according to the first embodiment of the present invention.
Figures 7A, 7B, 7C, 7D:
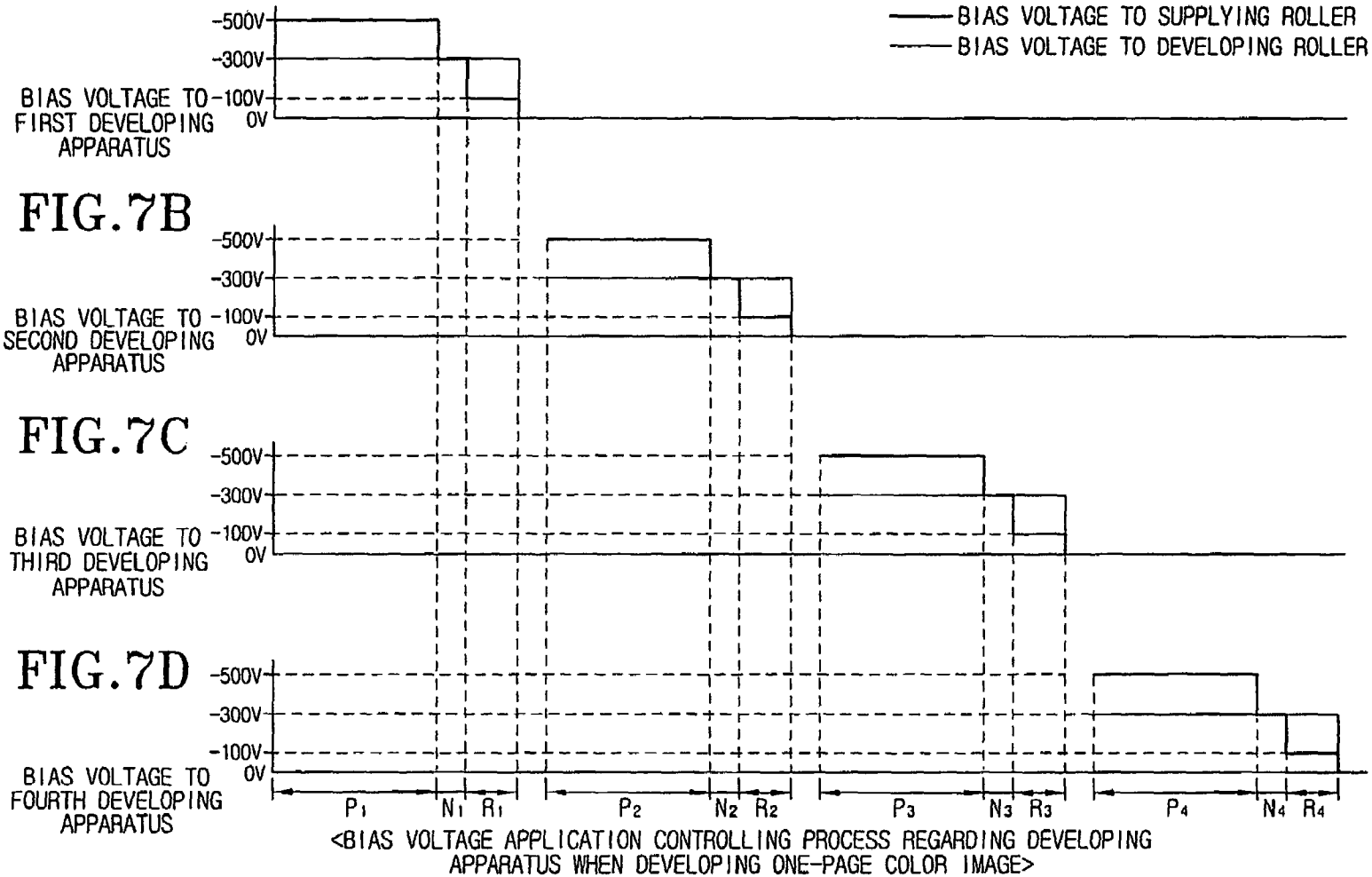
FIGS. 7A-7D show a process of controlling a bias voltage application with respect to first to fourth developing apparatuses according to the first embodiment of the present invention.

FIG. 6 shows sections of the photoconductive medium 100 supplied with the toner with reference to absolute coordinates of the photoconductive medium 100.

Referring to FIG. 6, since the positive bias voltage according to equation 1 is supplied ahead of the starting point F of the image area 100*a* by $C_d+\alpha_1\cdot L$ based on equation 1-1, the section $\alpha_1\cdot L$ is supplied with the toner T by the positive bias voltage.

Since the neutral bias voltage is supplied when the circular length $C_{0\cdot L}$ of the photoconductive medium 100 from the ending point E of the image area 100*a* to the center of the first developing area A1 becomes shorter than the circular length $C_d$ of the developing roller 412 from the center of the first toner supply area B1 to the center of the first developing area A1 by $\alpha_2\cdot L$, the section $\alpha_2\cdot L$ is supplied with the toner T supplied by the positive voltage. Accordingly, the section supplied with the toner T by the positive bias voltage is a $P_0$ shown in FIG. 6.

After that, since the neutral bias voltage is supplied until the timing of applying the reverse bias voltage is determined based on equation 3-1 and the reverse bias voltage is actually supplied, section $\beta_2\cdot L$ is a residual toner section. Also, if the neutral bias voltage according to equation 2-2, other than the positive bias voltage, is supplied after the reverse bias voltage is supplied, the section $\beta_1\cdot L$ is a neutral bias voltage section or voltage supply stop section. The section supplied with the neutral bias voltage is $N_{01}$ and $N_{02}$, shown in FIG. 6.

The section of the non-image area supplied with the reverse bias voltage is $R_0$ except for sections $P_0$, $N_{01}$ and $N_{02}$.

As described above, there is a certain section in which the toner T interferes with the positive or neutral bias voltage in the absolute coordinates of the non-image area 100*b* as shown in FIG. 6, so that a stable developing operation with respect to the image area 100*a* can be performed. Accordingly, an instable developing operation for the image area 100*a* due to the lack of toner can be prevented.

If all of $\alpha_1$, $\beta_1$, $\alpha_2$, $\beta_2$ are 0, the section $R_0$ interfered by the reverse bias voltage matches the total circular length L of the non-image area 100*b*. This means that the toner supplied by the positive bias voltage is accurately supplied to the image area 100*a*.

FIGS. 7A-7D show a degree and timing of applying the bias voltage to the respective developing apparatuses 410, 420, 430, 440 by the controlling apparatus 800 to form a one-page color image. In the intervals represented by the letter P, the positive bias voltage is supplied between the supplying roller and the developing roller, and therefore, the toner is supplied. In the intervals represented by the letter N, the neutral bias voltage is supplied between the supplying roller and the developing roller, and therefore, the toner is not supplied to the developing roller from the supplying roller any longer. In the intervals represented by the letter R, the reverse bias voltage is supplied between the supplying roller and the developing roller, and therefore, the toner remaining on the developing roller is collected.

As shown in FIGS. 7A-7D, when one of the developing apparatuses is supplied with the bias voltage from the voltage supplying apparatus 700 for the developing operation, the remaining developing apparatuses are not supplied with the bias voltage. Therefore, on the electrostatic latent image formed in order on the photoconductive medium 100 for the one-page color image, only one color of the toner adheres.

In addition, the toner adhered to the developing roller surface of the developing apparatus that has just finished developing is mostly collected on the supplying roller when the reverse bias voltage is supplied to the supplying roller. Therefore, the toner seldom adheres to the electrostatic latent image on the developing roller which is not in operation.

FIGS. 7A-7D show an example in which the neutral bias voltage is not supplied and the voltage supply is stopped after the reverse bias voltage is supplied. However, many other variations thereof are also possible. For example, the positive, neutral, and reverse bias voltages are supplied in order, and then, the neutral bias voltage according to equation 2-2 other than the positive bias voltage is supplied to a certain section of the non-image area 100*b*.

In another example, when one of the developing apparatuses is in developing operation, the controlling apparatus 800 controls the voltage supplying apparatus 700 such that the bias voltage supply is stopped in the remaining developing apparatuses or the neutral or reverse bias voltage continues to be supplied to the remaining developing apparatuses.

If $\alpha_1$, $\beta_1$, $\alpha_2$, $\beta_2$ are changed, the timings shown in FIGS. 7A to 7D are changed.

The degree of the bias voltage supplied to the developing apparatuses is not limited to the above-described values. Also, although in the example of FIGS. 7A to 7D, there is a certain interval between the toner collection interval R in which the revere bias voltage is supplied to a preceding developing apparatus, and the interval P in which the positive bias voltage is supplied to a subsequent developing apparatus, this should not be considered as limiting.

That is, according to the positions of the developing apparatuses and the size of the non-image area 100*b* of the photoconductive medium 100, the toner collection interval R may overlap with the interval P or there is no interval between the toner collection interval R and the interval P.

Further, an example of an image forming apparatus of a non-contact type developing has been described in the above embodiment, in which the developing apparatuses 410, 420, 430, 440 are spaced from the photoconductive medium 100 by a predetermined gap due to the presence of the gap ring 415. However, this embodiment of the present invention may also be applied to an image forming apparatus utilizing contact type developing in which the developing apparatus and the photoconductive medium 100 contact each other with a developing nip formed therebetween.

In an image forming apparatus according to a second embodiment of the present invention, the normal velocity So of the photoconductive medium 100 is higher than the normal velocity Sd of the developing roller, as shown in FIGS. 8A to 8D, which is different from the first embodiment. In this embodiment, the normal velocity So of the photoconductive medium 100 is two times higher than the normal velocity Sd of the developing roller.

According to the second embodiment, in the same manner as in the first embodiment, a home position detecting, an electrifying, and laser scanning processes are performed in order, and then, an image area 100*a* and a non-image area 100*b* are formed on the photoconductive medium 100.

Figure 8A:
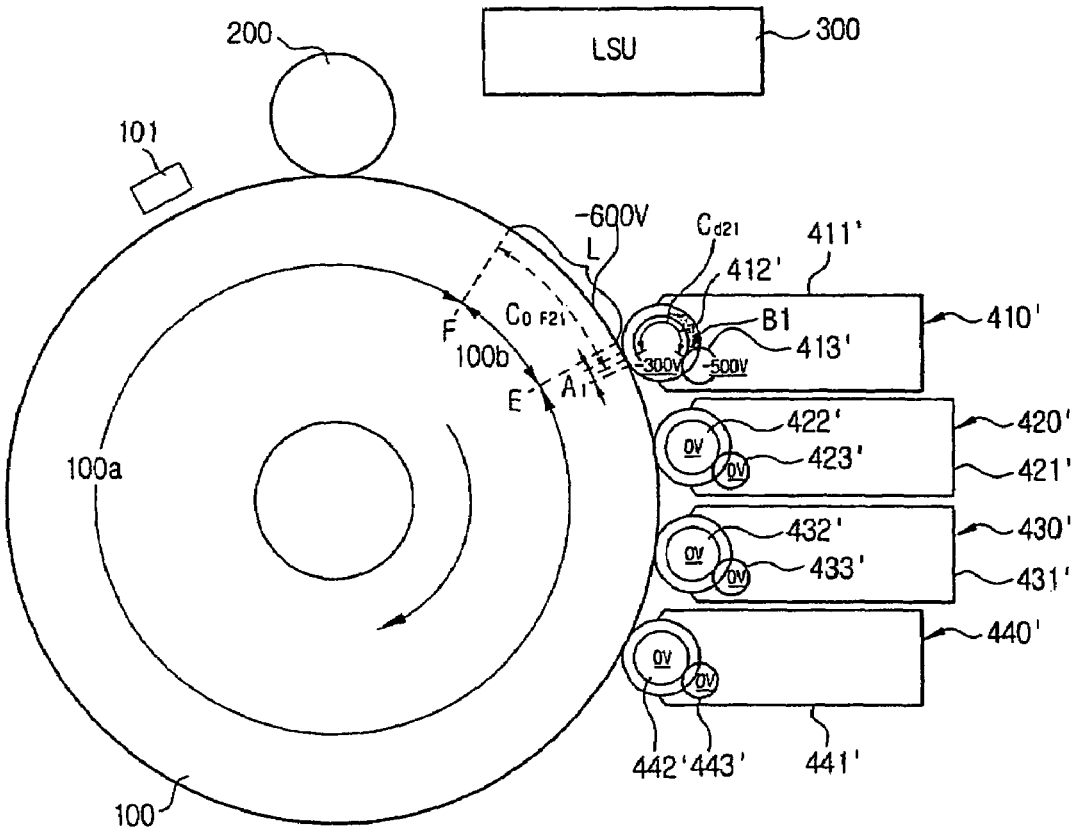
FIGS. 8A-8D show the operation of an image forming apparatus according to a second embodiment of the present invention.

After that, a positive bias voltage is supplied when a leading end of a section corresponding to a circular length $C_{0\cdot F21}$ obtained by equation 1-1 passes a first developing area A1 as shown in FIG. 8A. At this time, the circular length $C_{0\cdot F21}$ is two times longer than the circular length $C_{0\cdot F11}$ of the first embodiment shown in FIG. 4D. This is because the normal velocity So of the photoconductive medium 100 is two times higher than the normal velocity Sd of the first developing roller 412'.

Figure 8B:
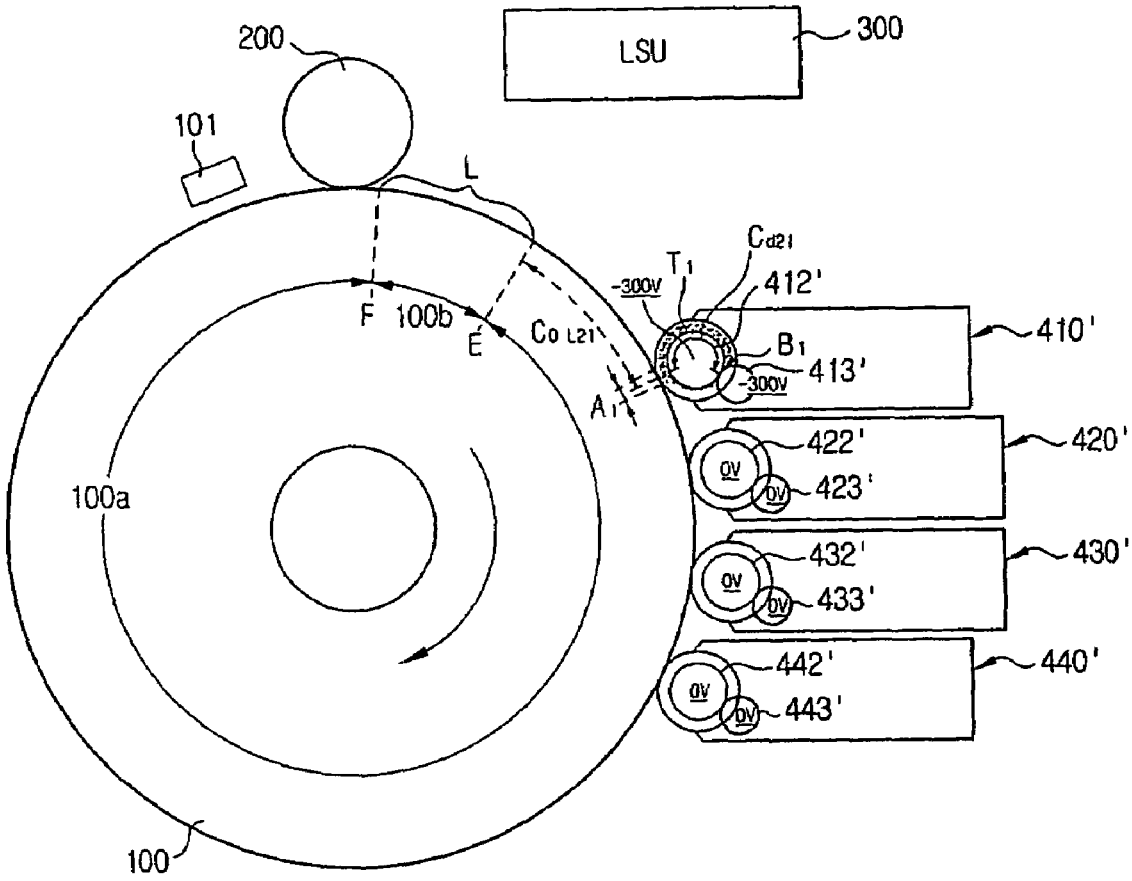

In the same manner as in the first embodiment, the positive bias voltage is supplied until a neutral bias voltage is supplied as shown in FIG. 8B. Herein, the neutral bias voltage is supplied when a circular length $C_{0\cdot L21}$ of the photoconductive medium 100 from an ending point E of the image area 100*a* to the center of the first developing area A1 satisfies equation 2-1. The circular length $C_{0\cdot L21}$ is two times longer than the circular length $C_{0\cdot L11}$ of the first embodiment shown in FIG. 4F.

Figure 8C:
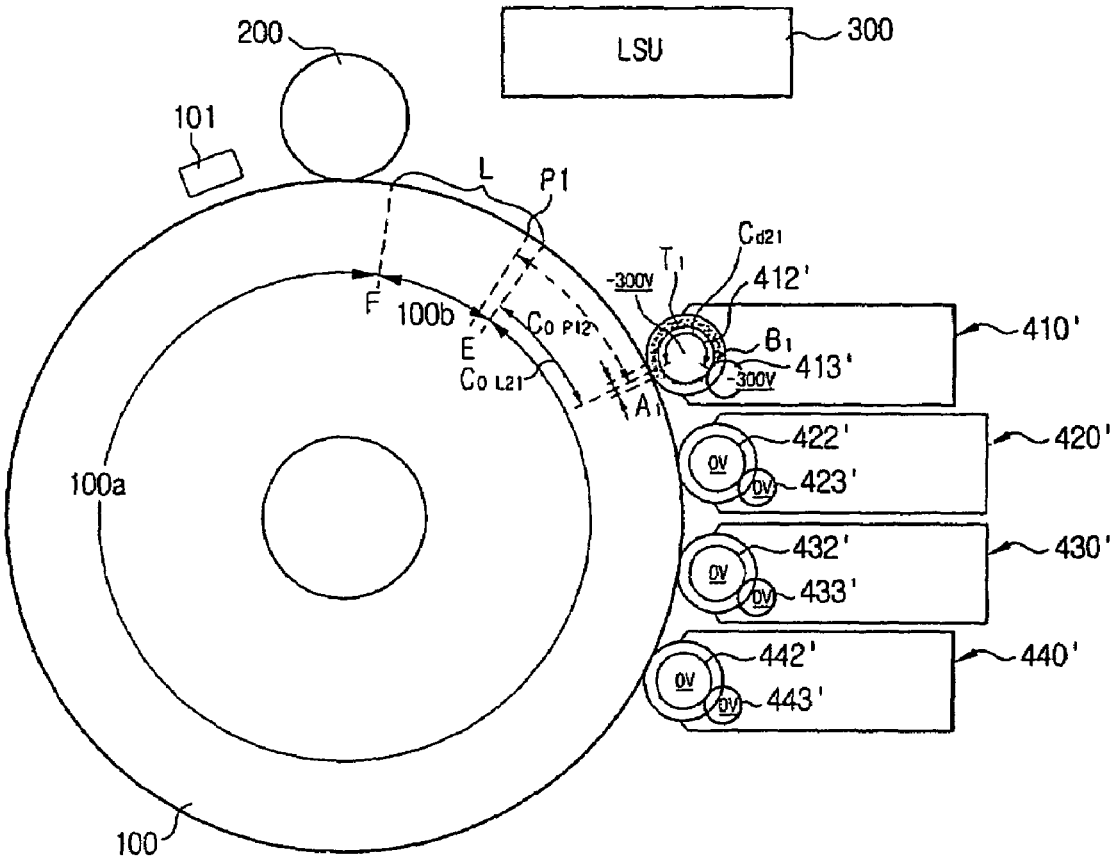
Figure 8D:
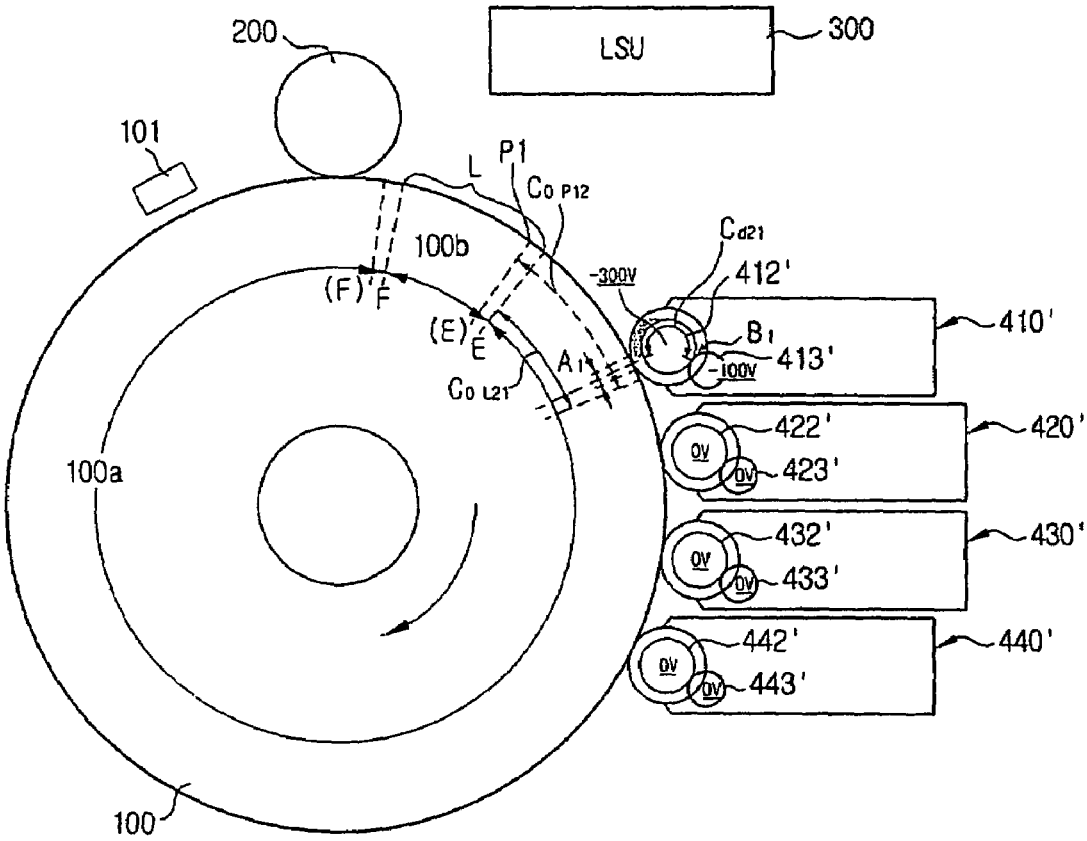

After that, a reverse bias voltage is supplied based on equation 3-1 as shown in FIGS. 8C to 8D. A circular length $C_{0\cdot P12}$ to determine the timing of supplying the reverse bias voltage is two times longer than the circular length $C_{0\cdot P11}$ of the first embodiment.

As described above, when the positive bias voltage and the neutral bias voltage are supplied between the first developing roller 412' and the first supplying roller 413', the toner T1 is supplied to the photoconductive medium 100, and after that, when the reverse bias voltage is supplied, the toner T is collected such that the developing operation of the first developing apparatus 410' is completed.

Of course, the neutral bias voltage according to equation 2-2 may be supplied to the non-image area 100*b* after the reverse bias voltage is supplied.

The above-described developing operation is accomplished in the second to fourth developing apparatuses 420', 430' and 440' by using the positive, neutral, and reverse bias voltages, and thus, a one-page color image is formed. Since the technical structure of the second embodiment is similar to that of the first embodiment, a detailed description thereof will be omitted.

In an image forming apparatus according to a third embodiment of the present invention, a normal velocity Sd of the developing roller is higher than a normal velocity So of the photoconductive medium 100 in contrast to the first embodiment. In this embodiment, the normal velocity Sd of the developing roller is two times higher than the normal velocity So of the photoconductive medium 100.

Figure 9A:
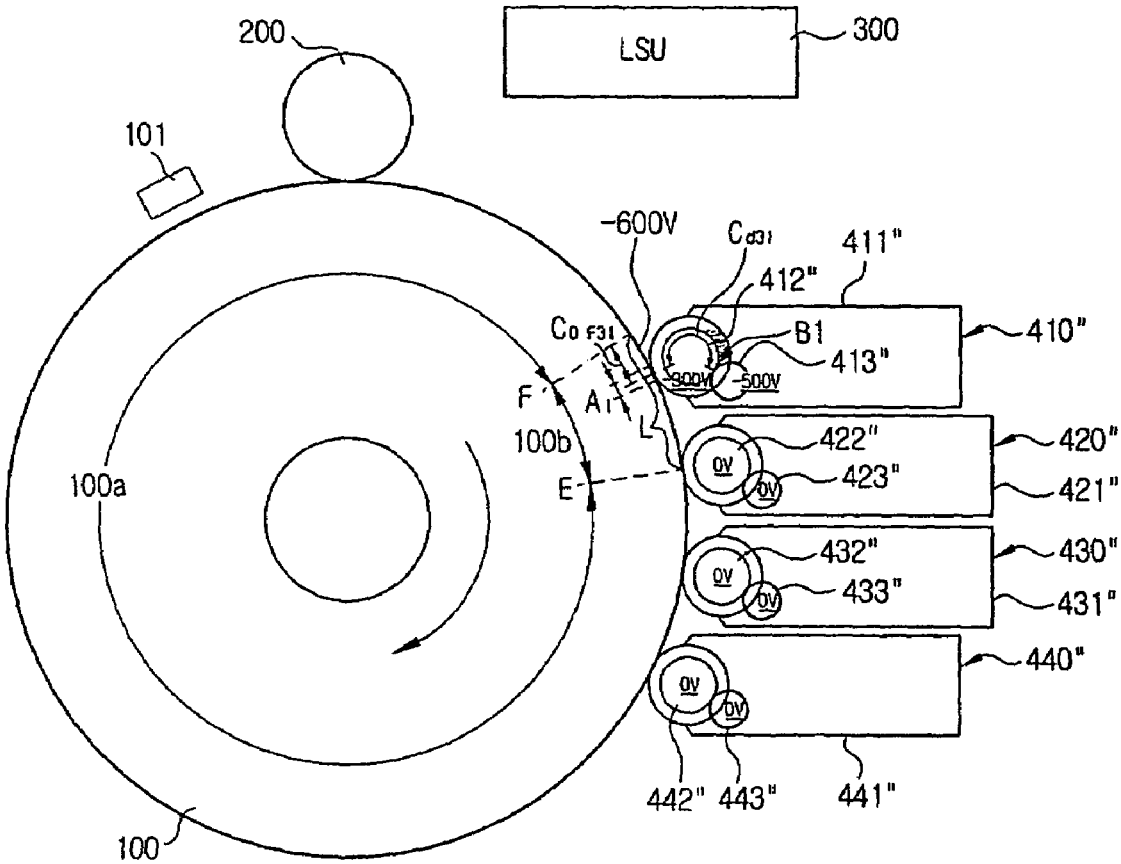
FIGS. 9A-9C show the operation of an image forming apparatus according to a third embodiment of the present invention.

Accordingly, as shown in FIG. 9A, a circular length $C_{0\cdot F31}$ to determine the timing of supplying the positive bias voltage according to equation 1 based on equation 1-1 is half as long as the circular length $C_{0\cdot F11}$ of the first embodiment shown in FIG. 4D. This is because (So/Sd) of equation 1-1 is 0.5.

Figure 9B:
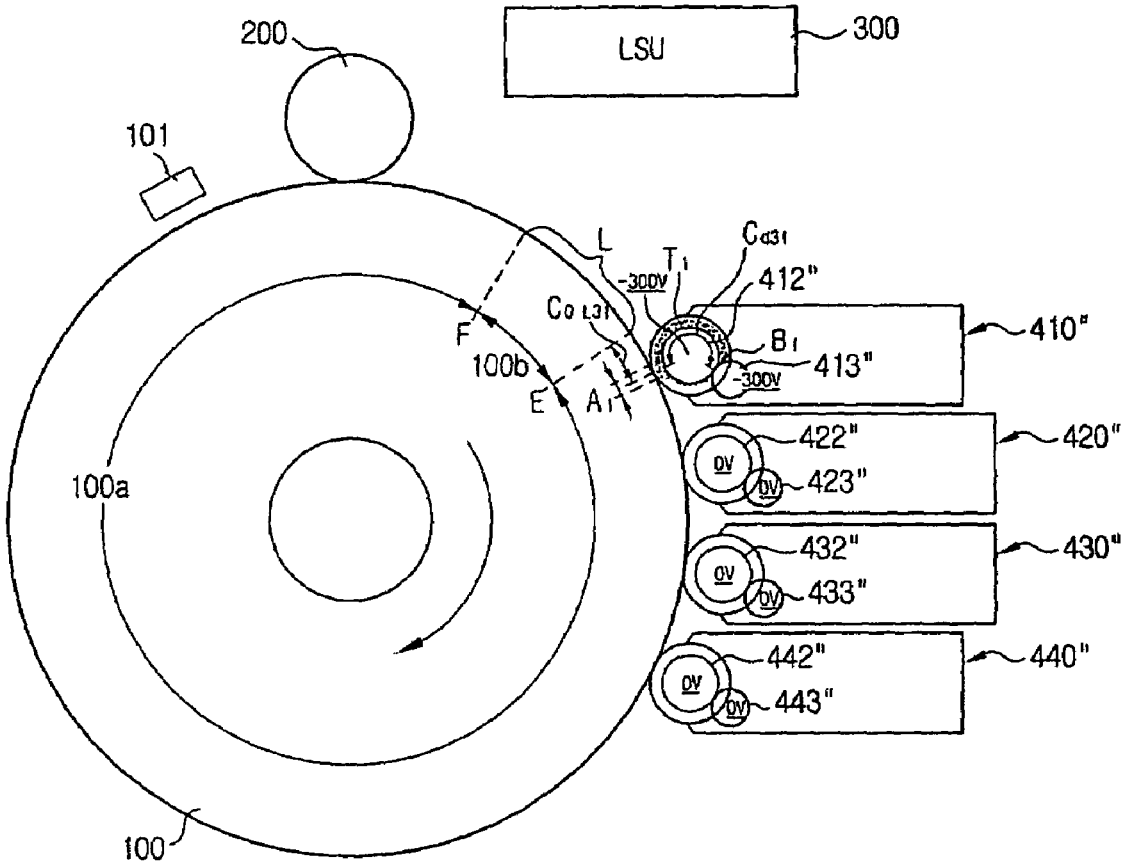
Figure 9C:
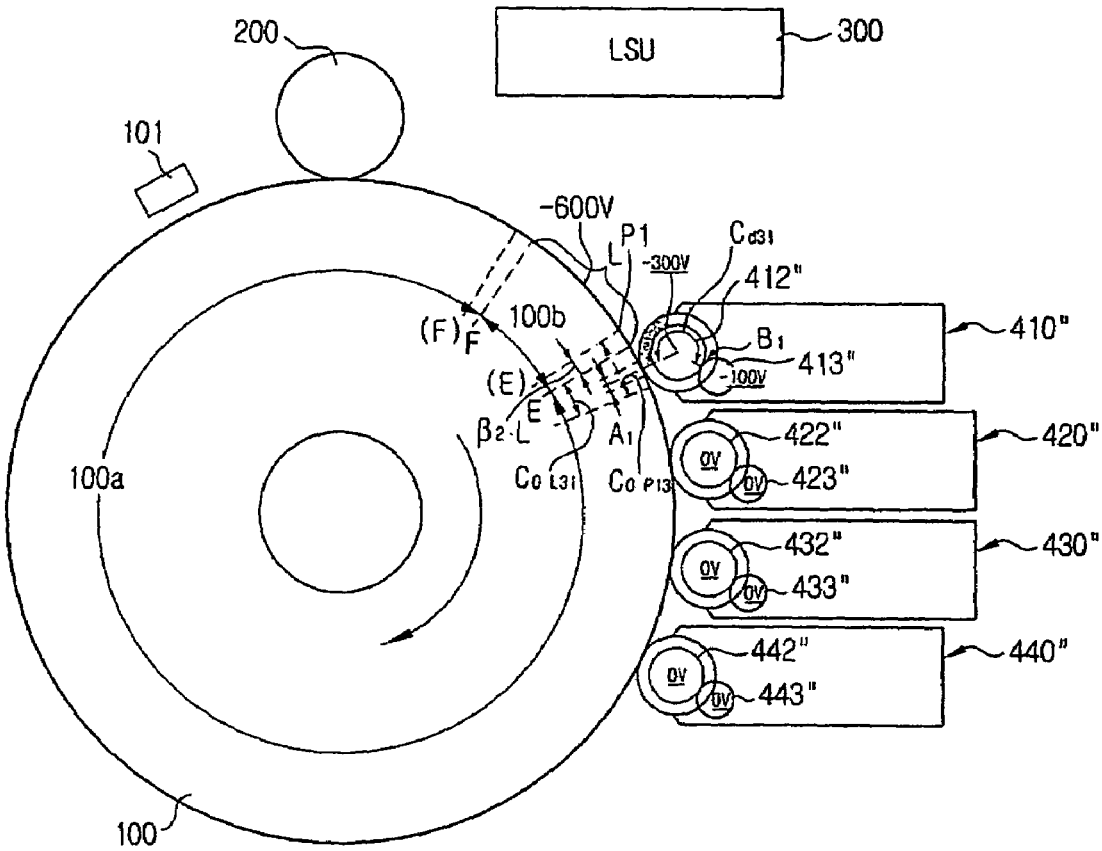

Also, as shown in FIGS. 9B and 9C, a circular length $C_d$ and a circular length. $C_{0\cdot P13}$ to determine the timings of supplying the neutral and reverse bias voltages based on equations 2-1 and 3-1 are half the circular lengths $C_{0\cdot L11}$ and $C_{0\cdot P11}$ of the first embodiment.

In the same manner as in the first and the second embodiments, developing and collecting operations of the first developing apparatus 410" according to the third embodiment are completed after the positive, neutral and reverse bias voltages are supplied in order. Since the developing and collecting operations of the second to fourth developing apparatuses 420", 430", 440" are similar to those of the first and the second embodiments, detailed descriptions thereof are omitted.

Figure 10A:
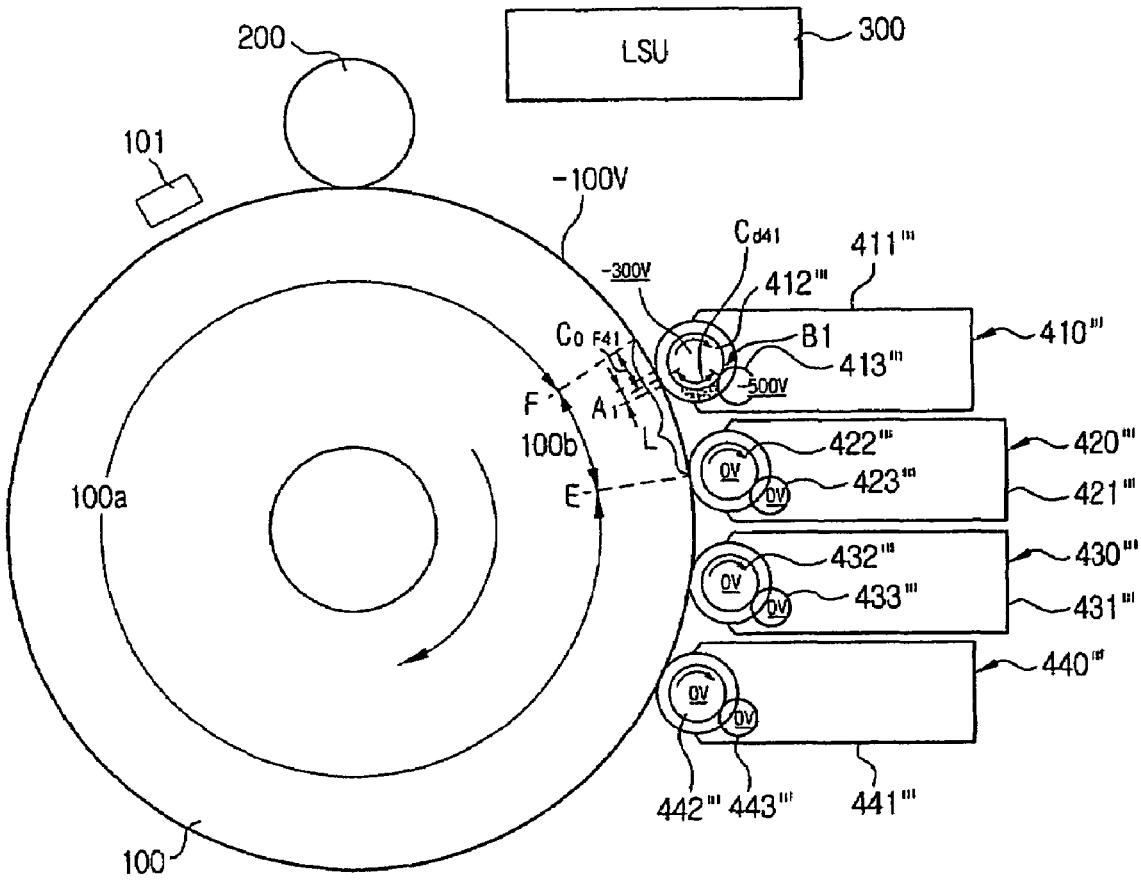
FIGS. 10A-10C show the operation of an image forming apparatus according to a fourth embodiment of the present invention.
Figure 10B:
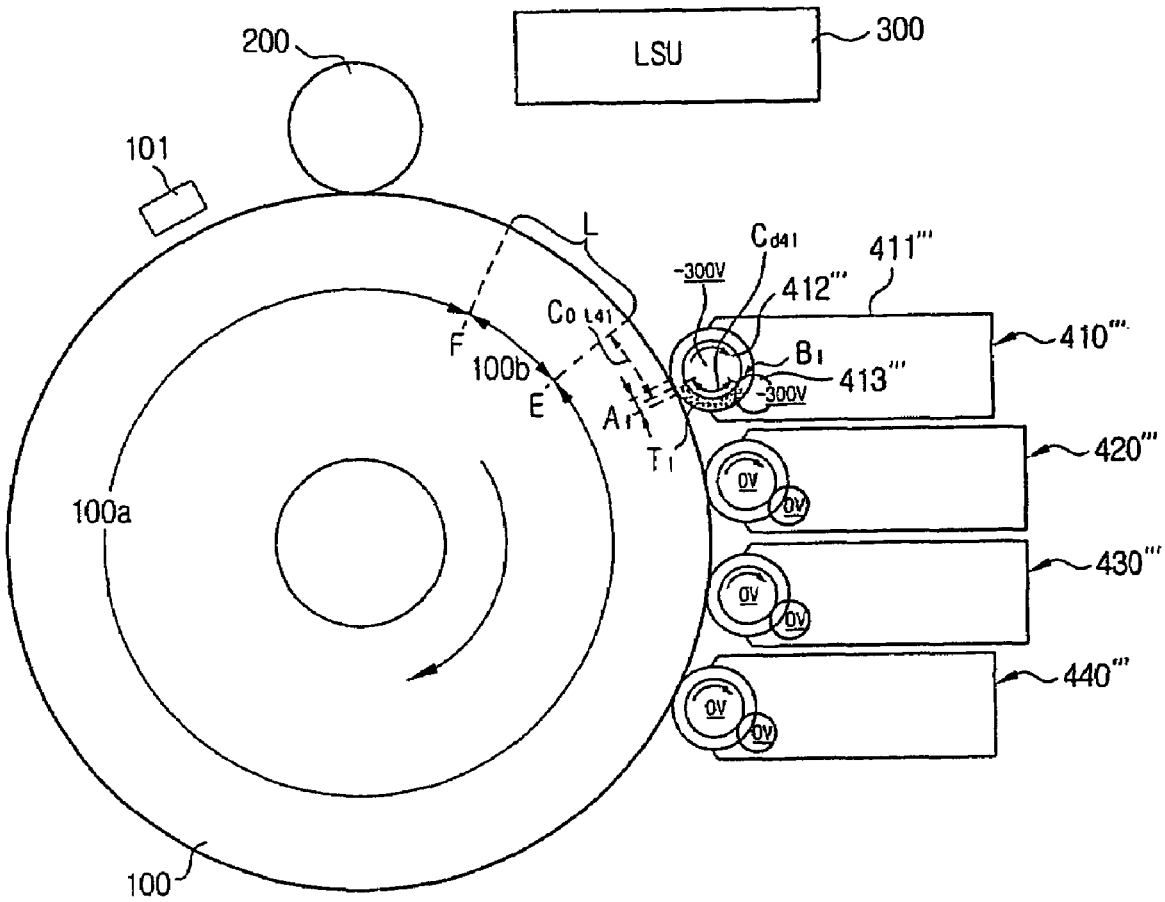
Figure 10C:
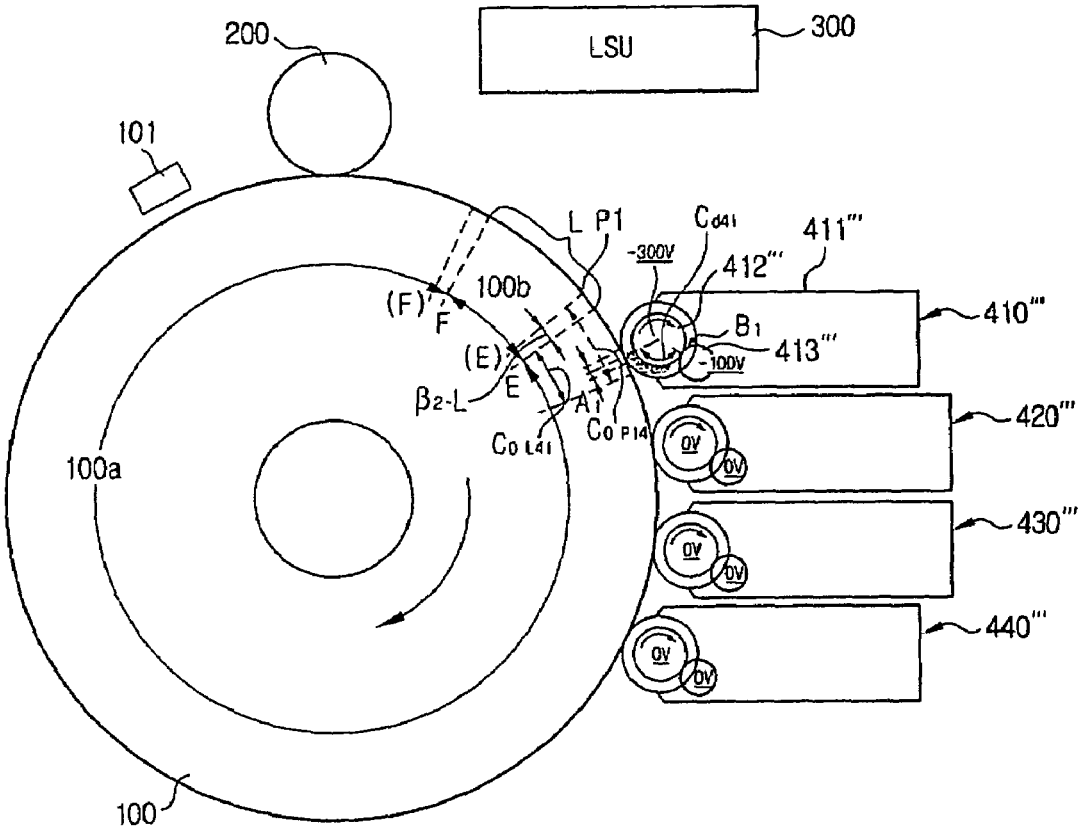

In an image forming apparatus according to a fourth embodiment of the present invention, the photoconductive medium 100 and the developing roller are rotated in the same direction as shown in FIGS. 10A to 10C.

For example, the photoconductive medium 100 and the developing roller are rotated in the clockwise direction. This is possible because the photoconductive medium 100 and the developing roller are rotated in a non-contact manner due to the presence of the gap ring 415. The photoconductive medium 100 and the developing roller are rotated at the same normal velocity as in the first embodiment.

According to the fourth embodiment, the photoconductive medium 100 is electrified by the electrifying apparatus 200 and scanned by the laser scanning unit 300 after the home position H is detected by the home sensor 101, and thereby forms an electrostatic latent image. After that, a first developing apparatus 410''' performs a developing operation.

In the same manner as in the first to third embodiments, the developing operation of the first developing apparatus 410''' is completed by supplying positive, neutral, and reverse bias voltages to a first supplying roller 413''' and a first developing roller 412''' based on equations 1 to 3-1 in order.

However, since the rotation direction of the first developing roller 412''' in the fourth embodiment is different from that of the first to third embodiments, a section $C_{d41}$ to calculate a circular length of the photoconductive medium 100 satisfying equations 1-1, 2-1, 2-2 and 3-1 is different from that of the first to fourth embodiments.

In this embodiment, section $C_{d41}$ is defined by a distance from the center of the first toner supply area B1 to the center of the first developing area A1 in a rotational direction of the first developing roller 412'''.

FIG. 10C illustrates an example in which a revere bias voltage is applied when an ending point E of the image area 100*a* passes the first developing area A1. Since the technical structure of the fourth embodiment is the same as the first embodiment except for the photoconductive medium 100 and the developing roller being rotated in the same direction, a detailed description thereof will be omitted.

As described above, although the photoconductive medium 100 and the developing roller are rotated in the same direction, the positive, neutral and reverse bias voltages can be controlled to be applied in order based on the above-described equations 1 to 3-1.

Although the photoconductive medium 100 and the developing roller are rotated in the same direction, the neutral bias voltage may be supplied for a predetermined interval after the reverse bias voltage is supplied to the non-image area 100*b* based on equation 2-2.

Also, although the photoconductive medium 100 and the developing roller are rotated at the same normal velocity in this embodiment, this should not be considered as limiting. That is, even if the normal velocity So of the photoconductive medium 100 is higher or lower than the normal velocity Sd of the developing roller, the positive, neutral and reverse bias voltages may be applied based on equations 1 to 3-1 in the same manner as the second to third embodiments Also, although the developing rollers of the plurality of developing apparatuses have the same diameter and are rotated in the same rotation direction in the first to the fourth embodiments, this should not be considered as limiting. That is, even if the developing rollers have different diameters and are rotated at different velocities and in different rotation directions, the positive, neutral and reverse bias voltages may be supplied in order, satisfying equations 1 to 3-1.

Also, although the first to fourth embodiments provide the first to fourth developing apparatuses, this should not be considered as limiting. That is, at least one developing apparatus is provided and the positive, neutral and reverse bias voltages are supplied to the at least one developing apparatus in order based on equations 1 to 3-1.

Finally, although the positive, neutral and reverse bias voltages are supplied in order and the toner is collected after being supplied, this should not be considered as limiting.

For example, if only the positive and neutral bias voltages are supplied to the supplying roller and the developing roller in order without the reverse bias voltage, only equations 1, 1-1, 2 and 2-1 are used. Also, if the neutral bias voltage is not supplied and only the positive and reverse bias voltages are supplied to the supplying roller and the developing roller, only equations 1, 1-1, 3 and 3-1 are used.

As described above, since the plurality of developing apparatuses are fixed at proper positions around the photoconductive medium 100 in a non-contact manner, noise or damage of parts can be prevented. This noise or damage is caused by a collision of the developing apparatuses with the photoconductive medium 100.

Additionally, according to the embodiment of the present invention, the toner adhered onto the developing roller is collected to the supplying roller immediately after the developing operation. Accordingly, only the toner of the developing apparatus currently in operation adheres to the electrostatic latent image on the photoconductive medium 100. As a result, a high-quality color image can be obtained.

Also, since the timings of applying the respective bias voltages are controlled and the optimal voltage applying timing is suggested, a stable image formation and a toner saving effect are achieved and an image contamination which is caused by the previously supplied toner can be effectively prevented.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

an electrifying apparatus;

a laser scanning unit;

a photoconductive medium electrified by the electrifying apparatus to a predetermined electric potential;

a developing apparatus having a developing roller to develop an electrostatic latent image formed on the photoconductive medium by the laser scanning unit and a supplying roller to supply a toner to the developing roller, the developing apparatus being fixed around the photoconductive medium;

a voltage supplying apparatus to supply a predetermined bias voltage to the developing roller and the supplying roller; and a controlling apparatus to control a degree and a timing of the bias voltage supplied to the developing roller and the supplying roller to thereby control a movement state of the toner between the supplying roller and the developing roller, wherein, if the bias voltage supplied to the developing roller is denoted by Vd and the bias voltage supplied to the supplying roller is denoted by Vs, the controlling apparatus controls the voltage supplying apparatus to satisfy equation 1 as follows when performing a developing operation and satisfies equation 2 after a predetermined time has elapsed $$|Vd|<|Vs| \quad \text{[Equation 1]}$$

$$|Vd|=|Vs| \quad \text{[Equation 2].}$$

2. The image forming apparatus of claim 1, wherein the photoconductive medium has an image area formed on a first part thereof, on which the electrostatic latent image is formed, and a non-image area formed on a second part thereof, and a toner supply area is provided between the supplying roller and the developing roller to move the toner and a developing area is provided between the developing roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from a starting point of the image area to the center of the developing area in a rotation direction of the photoconductive medium is denoted by $C_{0\cdot F}$, the controlling apparatus controls the voltage supplying apparatus to satisfy equation 1 from a time when the starting point of the image area satisfies:

$$C_{0\cdot F}=(C_d+\alpha_1\cdot L)\cdot(So/Sd),\ 0\leqq\alpha_1<0.5 \quad \text{[Equation 1-1]}$$

wherein L denotes an arc length of the non-image area, So denotes a normal velocity of a circumference of the photoconductive medium, Sd denotes a normal velocity of a circumference of the developing roller, and $\alpha_1$ denotes a real number.

3. The image forming apparatus of claim 1, wherein the photoconductive medium has an image area formed on a first part thereof, on which the electrostatic latent image is formed, and a non-image area formed on a second part thereof, and a toner supply area is provided between the supplying roller and the developing roller to move the toner and a developing area is provided between the supplying roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from an end point of the image area to the center of the developing area in a rotation direction of the photoconductive medium is denoted by $C_{0\cdot L}$, the controlling apparatus controls the voltage supplying apparatus to satisfy equation 2 from a time when equation 2-1 is satisfied:

$$C_{0\cdot L}=(C_d-\alpha_2\cdot L)\cdot(So/Sd),\ 0\leqq\alpha_2<0.5 \quad \text{[Equation 2-1]}$$

wherein L denotes an arc length of the non-image area, So denotes a normal velocity of a circumference of the photoconductive medium, Sd denotes a normal velocity of a circumference of the developing roller, and $\alpha_2$ denotes a real number.

4. The image forming apparatus of claim 1, wherein after the controlling apparatus controls the voltage supplying apparatus to satisfy equation 1 for a certain time, the controlling apparatus controls the voltage supplying apparatus to satisfy equation 3 as follows to thereby collect the toner:

$$|Vd|>|Vs| \quad \text{[Equation 3].}$$

5. The image forming apparatus of claim 4, wherein the controlling apparatus controls the voltage supplying apparatus to satisfy equation 2 as follows for a predetermined time when performing the developing operation:

$$|Vd|=|Vs| \quad \text{[Equation 2].}$$

6. The image forming apparatus of claim 5, wherein the photoconductive medium has an image area formed on a first part thereof, on which the electrostatic latent image is formed, and a non-image area formed on the second part thereof, and a toner supply area is provided between the supplying roller and the developing roller to move the toner and a developing area is provided between the supplying roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from an end point of the image area to the center of the developing area in a rotation direction of the photoconductive medium is denoted by $C_{0\cdot L}$, the controlling apparatus controls the voltage supplying apparatus to satisfy equation 2 from a time when equation 2-1 is satisfied:

$$C_{0\cdot L}=(C_d-\alpha_2\cdot L)\cdot(So/Sd),\ 0\leqq\alpha_2<0.5 \quad \text{[Equation 2-1]}$$

wherein L denotes an arc length of the non-image area, So denotes a normal velocity of a circumference of the photoconductive medium, Sd denotes a normal velocity of a circumference of the developing roller, and $\alpha_2$ denotes a real number.

7. The image forming apparatus of claim 6, wherein, if, with reference to a point of time satisfying equation 2-1, a circular length of the photoconductive medium from a first position of the non-image area defined by equation 3-1 as follows to the center of the developing area is denoted by $C_{0\cdot P1}$ and if the first position further moves from an initial point of the circular length $C_{0\cdot L}$ satisfying equation 2-1 by a difference between the circular lengths $C_{0\cdot L}$ and $C_{0\cdot P1}$, the controlling apparatus controls the voltage supplying apparatus to satisfy equation 3 and thereby collects the toner:

$$C_{0\cdot P1}=\{C_d-(\alpha_2-\beta_2)\cdot L\}\cdot(So/Sd),$$

$$0\leqq\alpha_2<0.5,$$

$$0\leqq\beta_2<0.5 \quad \text{[Equation 3-1]}$$

wherein $\beta_2$ denotes a real number and $(\alpha_2+\beta_2)$ is less than 0.5.

8. The image forming apparatus of claim 7, wherein, if, with reference to the point of time satisfying equation 2-1, a circular length of the photoconductive medium from a second position of the non-image area defined by equation 2-2 as follows to the center of the developing area is denoted by $C_{0\cdot P2}$ and if the second position further moves from the initial point of the circular length $C_{0\cdot L}$ by a difference between the circular lengths $C_{0\cdot L}$ and $C_{0\cdot P2}$, the controlling apparatus controls the voltage supplying apparatus to satisfy equation 2 or stop the voltage supply:

$$C_{0\cdot P2}=[C_d+\{1-(\alpha_1+\beta_1+2\alpha_2)\}\cdot L]\cdot(So/Sd),$$

$$0\leqq\alpha_1<0.5,$$

$$0\leqq\beta_1<0.5 \quad \text{[Equation 2-2]}$$

wherein $\alpha_1$ and $\beta_1$ denote real numbers, and $(\alpha_1+\beta_1)$ is less than 0.5.

9. The image forming apparatus of claim 1, further comprising a gap ring disposed at both ends of the developing roller and being rotated in contact with the photoconductive medium to maintain a developing gap between the developing roller and the photoconductive medium.

10. An image forming apparatus comprising:

an electrifying apparatus;

a photoconductive medium electrified by the electrifying apparatus to a predetermined electric potential;

a laser scanning unit;

a plurality of color developing apparatuses which are fixed around the photoconductive medium, each of the color developing apparatuses having a developing roller to adhere a predetermined color toner to an electrostatic latent image formed on the photoconductive medium by the laser scanning unit, and a supplying roller to supply the toner to the developing roller;

a voltage supplying apparatus to supply a predetermined bias voltage to the developing roller and the supplying roller; and a controlling apparatus to control a degree and a timing of supplying the bias voltage to the developing roller and the supplying roller to control a movement state of the toner between the supplying roller and the developing roller, wherein, if the bias voltage supplied to the developing roller is denoted by Vd and the bias voltage supplied to the supplying roller is denoted by Vs, the controlling apparatus controls the voltage supplying apparatus to satisfy equation 1 as follows when performing a developing operation and satisfies equation 2 after a predetermined time has elapsed $$|Vd|<|Vs| \quad \text{[Equation 1]}$$

$$|Vd|=|Vs| \quad \text{[Equation 2].}$$

11. The image forming apparatus of claim 10, wherein the controlling apparatus controls one of the plurality of color developing apparatuses to perform a developing operation of adhering a predetermined one of the color toners to the photoconductive medium.

12. The image forming apparatus of claim 11, wherein the photoconductive medium has an image area formed on a first part thereof, on which the electrostatic latent image is formed, and a non-image area formed on a second part thereof, and a toner supply area is provided between the supplying roller and the developing roller to move the toner and a developing area is provided between the developing roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from a starting point of the image area to the center of the developing area in a rotation direction of the photoconductive medium is denoted by $C_{0\cdot F}$, the controlling apparatus controls the voltage supplying apparatus to satisfy equation 1 from a time when the starting point of the image area satisfies:

$$C_{0\cdot F}=(C_d+\alpha_1\cdot L)\cdot(So/Sd),\ 0\leqq\alpha_1<0.5 \quad \text{[Equation 1-1]}$$

wherein L denotes an arc length of the non-image area, So denotes a normal velocity of a circumference of the photoconductive medium, Sd denotes a normal velocity of a circumference of the developing roller, and $\alpha_1$ denotes a real number.

13. The image forming apparatus of claim 11, wherein the photoconductive medium has an image area formed on a first part thereof, on which the electrostatic latent image is formed, and a non-image area formed on a second part thereof, and a toner supply area is provided between the supplying roller and the developing roller to move the toner and a developing area is provided between the supplying roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from an end point of the image area to the center of the developing area in a rotation direction of the photoconductive medium is denoted by $C_{0\cdot L}$, the controlling apparatus controls the voltage supplying apparatus to satisfy equation 2 from a time when equation 2-1 is satisfied:

$$C_{0\cdot L}=(C_d-\alpha_2\cdot L)\cdot(So/Sd),\ 0\leqq\alpha_2<0.5 \qquad \text{[Equation 2-1]}$$

wherein L denotes an arc length of the non-image area, So denotes a normal velocity of a circumference of the photoconductive medium, Sd denotes a normal velocity of a circumference of the developing roller, and $\alpha_2$ is a real number.

14. The image forming apparatus of claim 11, wherein the controlling apparatus controls the voltage supplying apparatus to satisfy equation 3 as follows and thereby collects the toner after the developing operation:

$$|Vd|>|Vs| \qquad \text{[Equation 3].}$$

15. The image forming apparatus of claim 14, wherein the controlling apparatus further controls the voltage supplying apparatus to satisfy equation 2 for a predetermined time when performing the developing operation:

$$|Vd|=|Vs| \qquad \text{[Equation 2].}$$

16. The image forming apparatus of claim 15, wherein the photoconductive medium has an image area formed on a first part thereof, on which the electrostatic latent image is formed, and a non-image area formed on a second part thereof, and a toner supply area is provided between the supplying roller and the developing roller to move the toner and a developing area is provided between the supplying roller and the photoconductive medium to move the toner, and wherein, if a circular length of the developing roller from a center of the toner supply area to a center of the developing area in a rotation direction of the developing roller is denoted by $C_d$ and if a circular length of the photoconductive medium from an end point of the image area to the center of the developing area in a rotation direction of the photoconductive medium is denoted by $C_{0\cdot L}$, the controlling apparatus controls the voltage supplying apparatus to satisfy equation 2 from a time when equation 2-1 is satisfied:

$$C_{0\cdot L}=(C_d-\alpha_2\cdot L)\cdot(So/Sd),\ 0\leqq\alpha_2<0.5 \qquad \text{[Equation 2-1]}$$

wherein L denotes an arc length of the non-image area, So denotes a normal velocity of a circumference of the photoconductive medium, Sd denotes a normal velocity of a circumference of the developing roller, and $\alpha_2$ denotes a real number.

17. The image forming apparatus of claim 16, wherein, if, with reference to a point of time satisfying equation 2-1, a circular length of the photoconductive medium from a first position of the non-image area defined by equation 3-1 as follows to the center of the developing area is denoted by $C_{0\cdot P1}$ and if the first position further moves from an initial point of the circular length $C_{0\cdot L}$ satisfying equation 2-1 by a difference between the circular lengths $C_{0\cdot L}$ and $C_{0\cdot P1}$, the controlling apparatus controls the voltage supplying apparatus to satisfy equation 3 and thereby collects the toner:

$$C_{0\cdot P1}=\{C_d-(\alpha_2-\beta_2)\cdot L\}\cdot(So/Sd),$$

$$0\leqq\alpha_2<0.5,$$

$$0\leqq\beta_2<0.5 \qquad \text{[Equation 3-1]}$$

wherein $\alpha_2$ and $\beta_2$ denote real numbers, respectively, and $(\alpha_2+\beta_2)$ is less than 0.5.

18. The image forming apparatus of claim 17, wherein, if, with reference to the point of time satisfying equation 2-1, a circular length of the photoconductive medium from a second position of the non-image area defined by equation 2-2 as follows to the center of the developing area is denoted by $C_{0\cdot P2}$ and if the second position further moves from the initial point of the circular length $C_{0\cdot L}$ satisfying equation 2-1 by a difference between the circular lengths $C_{0\cdot L}$ and $C_{0\cdot P2}$, the controlling apparatus controls the voltage supplying apparatus to satisfy equation 2 or stop the supply of the voltage:

$$C_{0\cdot P2}=[C_d+\{1-(\alpha_1+\beta_1+2\alpha_2)\}\cdot L]\cdot(So/Sd),$$

$$0\leqq\alpha_1<0.5,$$

$$0\leqq\beta_1<0.5 \qquad \text{[Equation 2-2]}$$

wherein $\alpha_1$ and $\beta_1$ denote real numbers, respectively, and $(\alpha_1+\beta_1)$ is less than 0.5.

19. The image forming apparatus of claim 10, further comprising a gap ring disposed at both ends of the developing roller and being rotated in contact with the photoconductive medium to maintain a developing gap between the developing roller and the photoconductive medium.

20. The image forming apparatus of claim 10, further comprising a transferring unit on which color toner images developed on the photoconductive medium are overlapped with one another.

* * * * *